US007281606B2

(12) United States Patent
Marocco

(10) Patent No.: US 7,281,606 B2
(45) Date of Patent: Oct. 16, 2007

(54) EXHAUST SOUND AND EMISSION CONTROL SYSTEMS

(76) Inventor: Gregory M. Marocco, 49 Stoney Brook Rd., Montville, NJ (US) 07045

( * ) Notice: Subject to any disclaimer, the term of this patent is extended or adjusted under 35 U.S.C. 154(b) by 241 days.

(21) Appl. No.: 11/198,484

(22) Filed: Aug. 8, 2005

(65) Prior Publication Data

US 2005/0279571 A1 Dec. 22, 2005

Related U.S. Application Data

(63) Continuation-in-part of application No. 10/663,751, filed on Sep. 17, 2003, now Pat. No. 6,935,461, which is a continuation-in-part of application No. 09/135,804, filed on Aug. 18, 1998, now abandoned, and a continuation-in-part of application No. 10/252,506, filed on Sep. 24, 2002, now Pat. No. 6,651,773.

(51) Int. Cl.

| | |
|---|---|
| ***F01N 1/08*** | (2006.01) |
| ***F01N 1/02*** | (2006.01) |
| ***F01N 3/10*** | (2006.01) |
| *F01N 1/10* | (2006.01) |
| *F01N 1/24* | (2006.01) |

(52) U.S. Cl. ..... 181/270; 181/272; 181/275; 181/258; 60/299

(58) Field of Classification Search ..... 181/270, 181/272, 275, 281, 268, 269, 256, 257, 258, 181/255, 252, 251, 249; 60/312, 322, 299, 60/301, 302

See application file for complete search history.

(56) References Cited

U.S. PATENT DOCUMENTS

| | | | | |
|---|---|---|---|---|
| 2,573,474 | A * | 10/1951 | Marx | 184/47 |
| 3,061,416 | A | 10/1962 | Kazokas | |
| 3,201,338 | A * | 8/1965 | Pennington | 204/193 |
| 3,695,851 | A * | 10/1972 | Perga | 422/179 |
| 3,817,714 | A * | 6/1974 | Wiley | 422/173 |
| 4,011,922 | A * | 3/1977 | Goplen | 181/272 |
| 4,032,310 | A | 6/1977 | Ignoffo | |
| 4,050,903 | A | 9/1977 | Bailey et al. | |
| 4,164,267 | A | 8/1979 | Meineke et al. | |
| 4,364,761 | A | 12/1982 | Berg et al. | |

(Continued)

FOREIGN PATENT DOCUMENTS

| | | |
|---|---|---|
| EP | 475398 | 3/1992 |

(Continued)

*Primary Examiner*—Edgardo San Martin
(74) *Attorney, Agent, or Firm*—Richard C. Litman

(57) ABSTRACT

The exhaust sound and emission control systems comprise a series of embodiments of devices for reducing sound and noxious emissions from an automotive exhaust. The system may have an exhaust resonator having one or more catalytic converter elements in combination therewith in a single device. Alternatively, the system may have multiple angularly disposed chambers therein, with a series of swept baffles or guides in one of the chambers, thereby combining resonator and muffler functions in a single device. In another alternative, the system has a series of longitudinal tubes therein in combination with a series of V-shaped guides or vanes, combining catalytic converter, muffler, and resonator functions in a single device. The various elements of the different embodiments, e.g. catalytic converter element(s), double wall shell, perforated tubes and multiple flow paths, interconnecting crossover tubes, etc., may be combined with one another as practicable.

20 Claims, 9 Drawing Sheets

U.S. PATENT DOCUMENTS

| | | | | | |
|---|---|---|---|---|---|
| 4,393,652 | A | | 7/1983 | Munro | |
| 4,425,304 | A | | 1/1984 | Kawata et al. | |
| 4,426,844 | A | | 1/1984 | Nakano | |
| 4,541,240 | A | | 9/1985 | Munro | |
| 4,851,015 | A | * | 7/1989 | Wagner et al. | 95/15 |
| 5,009,065 | A | * | 4/1991 | Howe et al. | 60/288 |
| 5,014,510 | A | | 5/1991 | Laimbock | |
| 5,016,438 | A | | 5/1991 | Harris | |
| 5,043,147 | A | | 8/1991 | Knight | |
| 5,108,716 | A | | 4/1992 | Nishizawa | |
| 5,183,976 | A | | 2/1993 | Plemons, Jr. | |
| 5,206,467 | A | | 4/1993 | Nagai et al. | |
| 5,220,789 | A | | 6/1993 | Riley et al. | |
| 5,248,859 | A | | 9/1993 | Borla | |
| 5,265,420 | A | | 11/1993 | Rutschmann | |
| 5,325,666 | A | | 7/1994 | Rutschmann | |
| 5,355,973 | A | | 10/1994 | Wagner et al. | |
| 5,378,435 | A | | 1/1995 | Gavoni | |
| 5,388,408 | A | | 2/1995 | Lawrence | |
| 5,398,504 | A | | 3/1995 | Hirota et al. | |
| 5,426,269 | A | | 6/1995 | Wagner et al. | |
| 5,477,014 | A | | 12/1995 | Dunne et al. | |
| 5,521,339 | A | | 5/1996 | Despain et al. | |
| 5,578,277 | A | * | 11/1996 | White et al. | 422/180 |
| 5,650,599 | A | | 7/1997 | Madden et al. | |
| 5,881,554 | A | | 3/1999 | Novak et al. | |
| 5,992,560 | A | | 11/1999 | Matsuoka et al. | |
| 6,006,859 | A | * | 12/1999 | Hussaini | 181/227 |
| 6,089,347 | A | | 7/2000 | Flugger | |
| 6,109,026 | A | | 8/2000 | Karlsson et al. | |
| 6,286,623 | B1 | * | 9/2001 | Shaya | 181/264 |
| 6,394,225 | B1 | | 5/2002 | Yasuda | |
| 6,431,311 | B1 | * | 8/2002 | Brown et al. | 181/282 |
| 6,651,773 | B1 | | 11/2003 | Marocco | |
| 6,776,257 | B1 | * | 8/2004 | Shaya | 181/272 |
| 6,935,461 | B2 | * | 8/2005 | Marocco | 181/270 |
| 7,219,764 | B1 | * | 5/2007 | Forbes | 181/270 |
| 2006/0090957 | A1 | * | 5/2006 | Stuber | 181/270 |

FOREIGN PATENT DOCUMENTS

| | | |
|---|---|---|
| JP | 55-043262 | 3/1980 |
| JP | 57-041414 | 3/1982 |
| JP | 62-291413 | 12/1987 |
| JP | 64-012017 | 1/1989 |
| JP | 02-169812 | 6/1990 |
| JP | 06-257421 | 9/1994 |
| JP | 10-141050 | 5/1998 |

* cited by examiner

EXHAUST SOUND AND EMISSION CONTROL SYSTEMS

REFERENCE TO RELATED PATENT APPLICATIONS

This application is a continuation-in-part of U.S. patent application Ser. No. 10/663,751, filed on Sep. 17, 2003, now issued as U.S. Pat. No. 6,935,461 on Aug. 30, 2005, which is a continuation in part of U.S. patent application Ser. No. 09/135,804 filed on Aug. 18, 1998, now abandoned, and U.S. patent application Ser. No. 10/252,506 filed on Sep. 24, 2002, now issued as U.S. Pat. No. 6,651,773 on Nov. 25, 2003.

BACKGROUND OF THE INVENTION

1. Field of the Invention

The present invention relates generally to automobile exhaust sound and emission control, including a catalytic exhaust converter and resonator installed within the exhaust system for the reduction of exhaust noise, and to an exhaust sound attenuation and control system having multiple flow paths for reducing exhaust noise.

2. Description of the Related Art

By the time of the 1950s, it was becoming apparent that the ever-increasing volume of automobile and truck traffic was generating exhaust emissions which were adversely affecting the environment. This was particularly true in urban areas and other areas where geographic and meteorological conditions combined to create areas where such emissions do not readily dissipate. Accordingly, by the late 1960s, various regulations were being implemented to require equipment to reduce exhaust emissions output from automobiles, particularly in California and other urban areas.

While early emissions control efforts provided some relief, standards have become increasingly strict in order to keep pace with the ever-increasing volume of automobile and truck traffic throughout the U.S.A. With the development of the catalytic converter, which uses one or more noble metals such as platinum, rhodium, and/or palladium to produce an oxidizing and/or reducing catalytic reaction with the exhaust products and heat generated by the exhaust, a real breakthrough was achieved in the control of vehicle emissions. An automobile equipped with one or more catalytic converters was capable of meeting most, if not all, of the exhaust emissions standards of the time, and the use of catalytic converters became commonplace on automobiles and light trucks powered by spark ignition engines in the U.S.A.

However, long before the recognition of chemical or particulate automobile exhaust emissions as a hazard, another type of automobile exhaust emission had been recognized, i.e., noise or sound. In fact, legislation in virtually every area of the world requires motor vehicles to have equipment which reduces this other emission. Accordingly, mufflers, resonators and other such sound attenuating devices have been known for many years, since shortly after the very earliest development of the internal combustion engine. These two types of emissions control devices, i.e., catalytic converters and mufflers or other sound attenuating devices, have generally not been combined into a single unit due to conflicting characteristics and physical requirements.

In the case of exhaust silencing devices, the maximum desired temperatures for such devices in operation are generally relatively low in comparison to the temperatures achieved in catalytic converters. Mufflers, resonators, and such sound attenuating devices are generally constructed of mild steel, perhaps with an aluminized exterior coating. Very high temperatures cause the aluminized coating to be burned off, and cause both the interior and (after removal of any coating) exterior to be oxidized, to the point of burn-through or rust-through, in relatively short order. While mufflers and other related devices have been constructed of stainless steel in order to reduce oxidation problems, these devices are relatively costly due to the material used and the difficulty in working with such material, in comparison to mild steel. Many, if not most, automobile owners would rather replace a standard steel exhaust system once or twice during their ownership of the car, rather than pay for a replacement system which costs perhaps three times that of a standard, mild steel system.

On the other hand, catalytic converters require relatively high temperatures for efficient operation. If a catalytic converter does not reach a minimum temperature, the catalytic reactions therein will be greatly reduced. Thus, most catalytic converters are constructed of relatively costly materials in order to withstand the heat generated therein. Even so, most converters are installed at some distance from the engine in order to preclude being subjected to excessive heat which could damage them.

While mufflers are generally installed toward the extreme downstream end of the exhaust system, many exhaust systems also incorporate a resonator. Resonators are also sound attenuation devices, but operate on a completely different principle than that of the muffler. The muffler is adapted to cancel most sounds therein by reflecting the sounds (and the exhaust) back and forth through a series of parallel pipes therein, and by forcing the exhaust gases laterally outwardly through relatively small passages in the pipes. The resonator is adapted to pass the exhaust gases therethrough with little or no impedance, while canceling or absorbing sounds within a certain relatively well defined frequency range. This range is generally relatively high, with the muffler being relied upon for the attenuation of lower exhaust frequencies.

As the resonator is adapted to attenuate different frequencies than the muffler, and operates on a different principle, it is generally placed elsewhere in the exhaust system, somewhat forwardly of the muffler, although the resonator may be placed either upstream or downstream of the muffler. The catalytic converter is typically installed forward of the muffler in an automobile, in order to avoid excessive exhaust heat while still accepting sufficient exhaust heat to function. While resonators do not generate internal heat due to chemically reacting the exhaust products, as do catalytic converters, they still must be structured to accept a relatively high exhaust temperature due to their location relatively near the engine. However, heretofore no combining of a catalytic converter and a resonator has been accomplished, to the knowledge of the present inventor.

Accordingly, a need will be seen for a catalytic converter and resonator combination which serves both purposes in a single device. The device may be installed in a conventional automobile exhaust system, between the engine and a conventional muffler and/or tailpipe. Different embodiments may be provided for single and dual exhaust systems, each of which may include one or more catalytic converter elements or "bricks." When used with a pre-catalytic converter, a muffler for further sound attenuation may not be required, depending upon the particular automobile, engine, and exhaust system.

It is also noted that mufflers and resonators have generally not been combined into a single unit due to conflicting characteristics and physical requirements. In another aspect of the present invention, an exhaust sound attenuating device is presented which serves the function of both muffler and resonator in a single unit, and may also include means for treating exhaust emissions as well. While the present inventor has developed devices which combine the function of the catalytic converter and resonator in a single device, he knows of no single device which combines the functions of the muffler and resonator in a single unit, and which may also include at least some limited catalytic conversion function as well. Such a device would be desirable, as it would save space beneath the vehicle, would reduce weight, and would likely reduce exhaust backpressure in comparison to a series of separate devices.

In addition to the above catalytic converter and resonator combination, and resonator and muffler combination with additional catalytic conversion function, the present disclosure also describes a series of alternative embodiments generally comprising a resonator type device having a series of longitudinally disposed tubes of various diameters and lengths therein. At least a portion of the exhaust gases pass through the tubes, with another portion of the gases passing through a series of V-shaped or swept baffles. The net effect is the canceling of exhaust noise across a relatively wide band of sound frequencies. The device may also incorporate one or more catalytic converter elements therewith, and/or may include a removable end or ends therewith for access to internal components. The removable end(s) may be incorporated with other devices disclosed herein, as well.

A discussion of the related art of which the present inventor is aware, and its differences and distinctions from the present invention, is provided below.

U.S. Pat. No. 3,061,416 issued on Oct. 30, 1962 to George P. Kazokas, titled "Catalytic Muffler," describes a device having a series of vanes within the inlet end and a peripherally disposed catalytic material, with a portion of the device further having a backflow of ambient air drawn through the outer shell by entrainment from the exhaust within the device. Kazokas notes his concern regarding the emission of lead in various forms into the atmosphere, from the burning of fuel containing tetraethyl lead. It is also known that the combustion products of leaded fuels will contaminate the catalytic elements of a catalytic converter, rendering it ineffective in a very few miles of vehicle operation using such leaded fuels. The solution provided by Kazokas is to separate the relatively heavy lead particles from other gases by means of centrifugal reaction. He provides a series of centrifugal vanes near the inlet end of his device for this purpose. However, leaded fuels have been banned for many years, and there is no further need to provide any swirling or centrifugal action to the gases passing through such a device. Accordingly, the vanes within the present exhaust devices or systems do not impart any swirling or centrifugal action to the gases passing therethrough. Moreover, the entrainment of ambient air through the outer shell of the Kazokas device has the effect of lowering the internal temperature within the device, thereby lessening the efficiency of the peripherally disposed catalytic conversion material along the inner shell. In contrast, the present systems locate such catalytic conversion materials and elements generally along the center of the device, where maximum temperatures occur to maximize the catalytic conversion reaction.

U.S. Pat. No. 4,032,310 issued on Jun. 28, 1977 to Vincent E. Ignoffo, titled "Muffler And Exhaust Gas Purifier For Internal Combustion Engines," describes a device having three joined components. The first component at the inlet end of the device comprises an empty expansion chamber, with no exhaust modifying componentry therein. The next chamber in line comprises a housing containing small particles of material for chemically treating the exhaust, i.e., carbon particles and/or noble elements for treating the gases catalytically. The outlet portion of the device includes a concentric sound absorbing material which surrounds an outlet pipe, with the volume of the pipe communicating with the sound absorbing material. The Ignoffo device is thus essentially a straight pipe having only a single pathway therethrough, with no convoluted pathway for the gases to follow. Such devices cannot serve as resonators, as they lack the multiple pathways required to cause different frequencies to occur, and to cancel those frequencies, thereby reducing the noise output of the system. While Ignoffo provides for access to the catalytic element of his device, he places this element in the center of the device, requiring both end components to be removed in order to repair or replace the central catalytic element. Moreover, Ignoffo uses a series of bolts installed through flanges, making the operation even more cumbersome.

U.S. Pat. No. 4,050,903 issued on Sep. 27, 1977 to Charles H. Bailey et al., titled "Combination Muffler And Catalytic Converter," describes a device having a relatively convoluted exhaust gas flow path therethrough. The exhaust gases enter through a venturi, which is used to draw air into the exhaust to mix therewith. (It is noted that mufflers are inherently pressurized somewhat higher than ambient when in operation, due to the backpressure created in such devices, yet Bailey et al. do not utilize any other means than the venturi effect to introduce the air into the muffler.) The exhaust and air are mixed by a deflector cone extending into the outlet of the venturi. From this point, the exhaust mixture passes through a series of holes in a transverse plate, and thence through holes in another plate to enter the catalytic converter. At least one catalytic converter element of the present invention is preferably located within the forward portion of the device, where it is subjected to the highest possible exhaust heat which occurs within the entire device. Bailey et al. locate their catalytic converter element in the rearward portion of the device, where the exhaust gases have cooled somewhat by their passage through the convoluted flow path of the forward muffler portion of the device. As the muffler itself is generally located to the rear of the exhaust system, some efficiency would be lost in the Bailey et al. device, due to the relatively cooler exhaust temperatures by the time the exhaust gases arrive at the catalytic converter element.

U.S. Pat. No. 4,164,267 issued on Aug. 14, 1979 to Sam W. Meineke et al., titled "Exhaust Muffler," describes the forming of the inlet and/or exhaust pipes of a muffler to provide for the attachment of the muffler to other upstream and downstream pipes. No internal configuration is disclosed for the muffler shown in the '267 U.S. patent, nor is there any disclosure of any combination of muffler/resonator/catalytic converter, as provided by various embodiments of the present invention.

U.S. Pat. No. 4,364,761 issued on Dec. 21, 1982 to Morris Berg et al., titled "Ceramic Filters For Diesel Exhaust Particulates And Methods For Making," describes a particulate trap for use with diesel engines. The Berg et al. device comprises a ceramic unit having a series of inlet and outlet passages therein. However, the inlet and outlet passages are not connected to one another. Rather, the ceramic material is porous, to allow gases to flow through the walls of the ceramic material from the inlet side to the outlet side. The porosity is configured to allow exhaust gases to flow, but to trap larger carbon particles typically generated during diesel engine operation. While Berg et al. describe their ceramic structure as having thin walls, this device cannot be used as a catalytic converter element, as the catalytic coatings would block the minute porosities between the inlet and outlet passages, thereby blocking gas flow through the device. In contrast, the present invention in its various embodiments utilizes conventional catalytic converter elements, and/or coats the sides of the internal passages with catalytic material to provide the desired reactions while also allowing exhaust gases to flow through the device.

U.S. Pat. No. 4,393,652 issued on Jul. 19, 1983 to John H. Munro, titled "Exhaust System For Internal Combustion Engines," describes an exhaust device including an upstream muffler, a generally centrally located spark and moisture arrestor, and a downstream chamber having a replaceable catalytic element therein. The disadvantage of locating the catalytic element farther from the combustion source, where the element receives less heat from the exhaust and thus produces a less efficient reaction, has been noted further above. Moreover, Munro describes the use of a gas absorbent or adsorbent material, such as charcoal, in combination with his catalytic element. The use of an adsorbent material such as charcoal in a motor vehicle engine exhaust system is not understood, as the relatively large volume of exhaust gases passing through the system would result in the adsorption of only a miniscule quantity of impurities in the exhaust, in comparison to the total exhaust volume relative to the amount of charcoal in the system. The amount of charcoal required to absorb the vast majority of impurities from the exhaust of a motor vehicle engine, would be prohibitive.

U.S. Pat. No. 4,425,304 issued on Jan. 10, 1984 to Masayuki Kawata et al., titled "Catalytic Converter," describes a device comprising a single shell or container with two converter units or "bricks" installed in series therein. No sound attenuating means is disclosed by Kawata et al. in their catalytic converter.

U.S. Pat. No. 4,426,844 issued on Jan. 24, 1984 to Keiichi Nakano, titled "Engine Muffler Of Heat-Exchanging Type," describes a device incorporating a pair of catalytic converter components therein. The two catalytic converter components are positioned in front of the heat exchanger, which also acts as a muffler. Exhaust gas flow enters the device by means of a radial pipe, and flows radially to enter and exit the myriad of axial heat exchange passages in the muffler and heat exchanger element. The present device utilizes multiple flow paths forming a generally sinusoidal path therethrough.

U.S. Pat. No. 4,541,240 issued on Sep. 17, 1985 to John H. Munro, titled "Exhaust System For Internal Combustion Engines," is a divisional patent of the parent '652 U.S. patent to the same inventor, discussed further above. The same points raised in the discussion of the Munro '652 patent are seen to apply to the Munro '240 U.S. patent as well.

U.S. Pat. No. 5,014,510 issued on May 14, 1991 to Franz Laimbock, titled "Exhaust System, Particularly For Two-Stroke Cycle Internal Combustion Engines," describes an exhaust assembly having a relatively wider expansion area which includes a primary catalytic converter therein. A longitudinal divider is installed upstream of the primary catalytic converter element, with the divider also being coated with catalytically reactive material. It is well known that two stroke cycle exhaust systems are relatively limited in their configurations, as it is critical that the system be tuned so as to assist each exhaust pulse in its passage in order to draw the subsequent pulse or charge from the cylinder, in order to attain optimum efficiency and to preclude overheating of the engine. Accordingly, Laimbock does not provide any internal baffling within his exhaust system in order to attenuate noise levels, as is provided by the present exhaust system.

U.S. Pat. No. 5,016,438 issued on May 21, 1991 to Harold L. Harris, titled "Emission Control Apparatus," describes a combination exhaust device having a pair of catalytic converter elements in tandem therein. Only a portion of the exhaust gases pass through the first element, with some of those gases being recirculated back through the first element. All of the exhaust gases pass through the second element. In contrast, all exhaust gases pass through all of the catalytic converter elements of the present invention, when plural elements are provided in tandem. In addition, Harris places his catalytic elements generally in the center of his exhaust device, where the heat is reduced in comparison to the entry end of the device. The loss of efficiency for catalytic converter elements operating at lower heat levels has been noted further above.

U.S. Pat. No. 5,043,147 issued on Aug. 27, 1991 to Glen Knight, titled "Combined Muffler And Catalytic Converter Exhaust Unit," describes a device with a pair of converters being installed within the first portion of the muffler shell. The exhaust gases are then forced to travel a sinusoidal, convoluted path forward and aft through the muffler portion, with gases being exchanged between various pipes within the muffler portion due to perforations provided through the pipes. The gas flow path through the Knight system is unlike that of the present exhaust control device.

U.S. Pat. No. 5,108,716 issued on Apr. 28, 1992 to Kimiyoshi Nishizawa, titled "Catalytic Converter," describes a device having two converter components housed within a single container or shell. No sound attenuation means is disclosed by Nishizawa, as provided by the present catalytic converter and resonator combination.

U.S. Pat. No. 5,183,976 issued on Feb. 2, 1993 to R. J. Plemons, Jr., titled "Adjustable Sound Attenuating Device," describes a resonator type device having essentially a straight through flow pattern. No double wall outer shell, additional sound insulating material, or catalytic elements are disclosed by Plemons, Jr. in his exhaust device.

U.S. Pat. No. 5,206,467 issued on Apr. 27, 1993 to Noboru Nagai et al., titled "Muffler With A Catalyst," describes a relatively small, canister type muffler as used on small two and four stroke engines (e.g., lawnmowers, etc.). The Nagai et al. muffler essentially has four compartments, with a pipe-like first compartment projecting into a second compartment, which communicates with a third compartment which leads to a small fourth compartment with a relatively small exhaust outlet passage. The exhaust gases do not pass longitudinally through a series of elongate passages, as in the present system, and the configuration of the Nagai et al. device cannot provide any resonator effect.

U.S. Pat. No. 5,220,789 issued on Jun. 22, 1993 to James E. Riley et al., titled "Integral Unitary Manifold-Muffler-Catalyst Device," describes an exhaust manifold and system which is bolted directly to the cylinder head of the engine. While Riley et al. include a conventional catalytic converter element, or "brick," within their manifold, they fail to include any internal baffling to control the exhaust sound level within their manifold. The only internal passages within their device are formed by the relatively small, straight passages of the catalytic converter element itself, which Riley et al. prefer to be as nearly straight as possible to encourage laminar flow therethrough. In contrast, the present system provides a circuitous exhaust flow path therethrough, to attenuate noise levels optimally.

U.S. Pat. No. 5,248,859 issued on Sep. 28, 1993 to Alexander Borla, titled "Collector/Muffler/Catalytic Converter Exhaust Systems For Evacuating Internal Combustion Engine Cylinders," describes various embodiments of an exhaust system in which a muffler jacket may be installed surrounding a collector unit. Borla also provides catalytic converter elements, but in each case the catalytic converter elements are installed as separate units within the individual exhaust header pipes adjacent the cylinder head of the engine, or in the individual header pipes immediately upstream of the collector. No internal resonator structure is provided by Borla, nor does he utilize a single catalytic converter element or multiple elements in tandem disposed within a single exhaust passage, as provided by the present exhaust system invention.

U.S. Pat. No. 5,265,420 issued on Nov. 30, 1993 to Erwin Rutschmann, titled "Exhaust System Of A Multi-Cylinder Reciprocating Engine," describes a system in which a single catalytic converter is provided for each cylinder bank of a V-8 engine. Exhaust gases pass through the two catalytic converters, thence to a single transverse muffler. Thus, Rutschmann requires three separate housings or units for the two catalytic converters and single muffler of his system, whereas the present catalytic converter and resonator combination are combined within a single housing. No resonator is disclosed by Rutschmann.

U.S. Pat. No. 5,325,666 issued on Jul. 5, 1994 to Erwin Rutschmann, titled "Exhaust System Of An Internal-Combustion Engine," describes a system somewhat similar to the apparatus of the '420 U.S. patent to the same inventor, discussed immediately above. The convoluted routing of the exhaust gases, the use of separate housings or components for the catalytic converters and mufflers, the use of a plenum around the catalytic converters, and other differences, make the Rutschmann apparatus distinct from the present catalytic converter and resonator combination. Again, it must be noted that a muffler is not a resonator, and does not provide straight through flow of exhaust gases and the attenuation of a relatively narrow range of frequencies.

U.S. Pat. No. 5,355,973 issued on Oct. 18, 1994 to Wayne M. Wagner et al., titled "Muffler With Catalytic Converter Arrangement; And Method," describes a muffler having a straight flow through pattern; no convoluted or sinusoidal flow pattern is provided in the Wagner et al. exhaust device. While Wagner et al. provide a concentric tubular element within their muffler, they do not provide a series of parallel tubular exhaust passages serving as a resonator, as in the present invention, nor do they provide a series of V-shaped baffles in combination with such tubular elements. Moreover, no double walled shell having additional acoustic insulation therein is disclosed by Wagner et al., which structure is a part of at least some embodiments of the present exhaust system invention.

U.S. Pat. No. 5,378,435 issued on Jan. 3, 1995 to Albino Gavoni, titled "Silencer Combined With Catalytic Converter For Internal Combustion Engines And Modular Diaphragm Elements For Said Silencer," describes an essentially cylindrical container with a series of cup-shaped catalytic converter elements arranged therein. The elements are each relatively thin, due to the cup-like shape of each element, and thus do not present a significant cross sectional area to the exhaust gases passing therethrough. Thus, a great many such elements are required, unlike the present catalytic converter and resonator combination.

U.S. Pat. No. 5,388,408 issued on Feb. 14, 1995 to Phillip G. Lawrence, titled "Exhaust System For Internal Combustion Engines," describes a dual muffler system in which the mufflers are teed from a single exhaust line upstream, which is in turn fed by one or more catalytic converters. The mufflers of the Lawrence system are essentially straight through devices having a series of pipes therein of different lengths. While the Lawrence system discloses dual mufflers, their connection to a single point upstream is unlike the dual exhaust embodiment of the present invention. Moreover, no V-shaped vanes are provided by Lawrence in combination with his plurality of different length tubes, nor does he provide one or more catalytic converter elements contained within the same housing as the muffler and resonator device, as is done with the present invention.

U.S. Pat. No. 5,398,504 issued on Mar. 21, 1995 to Tomotaka Hirota et al., titled "Layout Structure Of Catalytic Converters," describes a system in which first and second converters are installed immediately adjacent the respective cylinder banks of a V-configuration engine. A separate third, main converter is provided beneath the engine. Each of the converters is contained in a separate housing or shell, unlike the combined catalytic converter and resonator of the present invention. Moreover, Hirota et al. do not disclose any form of exhaust silencing or noise attenuating means in their system, as is provided by the present catalytic converter and resonator combination.

U.S. Pat. No. 5,426,269 issued on Jun. 20, 1995 to Wayne M. Wagner et al., titled "Muffler With Catalytic Converter Arrangement; And Method," describes a series of embodiments of a muffler having a conventional catalytic converter element axially disposed therein. The path of the exhaust gas flow may take any of a few different routes, depending upon the specific embodiment of the Wagner et al. device. In at least one embodiment, the flow passes axially through the muffler, from one end to the other. In at least one other embodiment, flow doubles back through the muffler shell to exit radially from a port adjacent the axial inlet. None of the embodiments disclose a multiple path internal configuration corresponding to that of the present device.

U.S. Pat. No. 5,477,014 issued on Dec. 19, 1995 to Stephen R. Dunne et al., titled "Muffler Device For Internal Combustion Engines," describes an otherwise conventional muffler, but having an internal coating of zeolite material for protecting the underlying metal structure from corrosion. The Dunne et al. coating does nothing to catalyze exhaust emissions, but is solely directed to the protection of the metal structure of the muffler. Moreover, the Dunne et al. muffler is conventional, as noted above. Among other conventional features, it includes relatively small diameter internal passages, which have diameters smaller than those of the inlet and outlet pipes. This results in excessive flow restriction, which is avoided in at least one of the embodiments of the present exhaust system configuration with its relatively large diameter internal passages.

U.S. Pat. No. 5,521,339 issued on May 28, 1996 to Michael S. Despain et al., titled "Catalyst Muffler System," describes a relatively small muffler unit intended for use on a two stroke cycle type engine, e.g., chainsaw, lawnmower, etc. The Despain et al. muffler passes the exhaust gases back over the catalytic converter element therein, after passing through the catalyst element. No multiple paths for exhaust gases are provided by the Despain et al. muffler, whereas the present system includes such passages in each of its various embodiments.

U.S. Pat. No. 5,650,599 issued on Jul. 22, 1997 to Peter E. Madden et al., titled "Noise Cancellation Method And Apparatus," describes a device employing electronic noise canceling means. The device is primarily directed to use with a reaction type engine, e.g., a turbojet, rather than to the exhaust of a reciprocating engine or the like. The exhaust is divided into a series of separate ducts, with each duct having its own electronic noise canceling system or apparatus therein. No acoustic muffling or resonating means is disclosed by Madden et al., nor is any catalytic or other conversion of exhaust products disclosed by Madden et al.

U.S. Pat. No. 5,881,554 issued on Mar. 16, 1999 to James Michael Novak et al., titled "Integrated Manifold, Muffler, And Catalyst Device," describes a relatively large and bulky assembly having a series of individual exhaust tubes within a larger manifold housing. The tubes lead to a catalytic converter element, with the internal manifold volume also communicating with the catalytic element. The tubes are perforated to allow gas flow to pass therefrom to the internal volume of the manifold, whereby the assembly acts as a resonator. However, while Novak et al. state that their device also serves as a muffler, no muffler elements are disclosed within the device. In contrast, the present system provides multiple flow paths as a muffler and resonator.

U.S. Pat. No. 5,992,560 issued on Nov. 30, 1999 to Hirotake Matsuoka et al., titled "Muffler For Internal Combustion Engine," describes a straight through flow configuration having circumferentially surrounding acoustic absorbent material. The acoustic absorbent material is preferably glass fiber, which Matsuoka et al. describe as being susceptible to melting and forming small beads, which then pass through the perforations in the inner pipe to be blown from the exhaust system. Matsuoka et al. provide a "scattering prevention member" comprising a fine mesh wire screen surrounding the inner pipe, in order to retain any fine glass beads which may be formed, within their intended area. Matsuoka et al. do not disclose any multiple tube construction, multiple flow paths, catalytic converter elements, or other features of the present invention.

U.S. Pat. No. 6,089,347 issued on Jul. 18, 2000 to Ray T. Flugger, titled "Muffler With Partition Array," describes a series of embodiments each having a number of angled deflector plates installed therein. Some of the embodiments include a series of V-shaped deflectors therein. However, none of the embodiments of the Flugger muffler configurations include any form of multiple pipes providing multiple flow paths, double wall construction, catalytic converter elements, or other features of the present exhaust system invention.

U.S. Pat. No. 6,109,026 issued on Aug. 29, 2000 to Egon Karlsson et al., titled "Muffler With Catalytic Converter," describes a small canister type muffler for use with relatively small two stroke cycle type engines. The Karlsson et al. muffler has a configuration more closely resembling that of the Nagai et al. '467 and Despain et al. '339 U.S. patents, than the present exhaust system invention. The points of difference raised in the discussion of the Nagai et al. and Despain et al. mufflers, are seen to apply here as well.

U.S. Pat. No. 6,394,225 issued on May 28, 2002 to Kazuhiro Yasuda, titled "Muffler Structure," describes a muffler having a series of tubes installed within an outer shell. The tubes are held in place by internal baffles, which cause the gases to flow back and forth through the various tubes. However, Yasuda does not include any form of V-shaped baffles or guides within his muffler nor does he provide any form of catalytic converter element, removable end component, or other features of the present exhaust system invention.

U.S. Pat. No. 6,651,773 issued on Nov. 25, 2003 to the present inventor, titled "Exhaust Sound Attenuation And Control System," describes a series of embodiments of combination muffler, resonator, and catalytic converter devices. The present disclosure is a continuation of an intervening continuation application based upon the issued '773 U.S. patent, the disclosure of which is incorporated herein by reference. The present invention comprises a series of heretofore undisclosed improvements and variations upon the combination device of the issued '773 U.S. patent, and other devices of the intervening and pending continuation application.

Japanese Patent Publication No. 55-43262 published on Mar. 27, 1980 illustrates an exhaust gas purifier in which the catalytic converter unit includes a baffle within its inlet end to preclude interference between exhaust gases alternatingly entering the converter from the no. 1 and no. 4 cylinders, and the no. 2 and no. 3 cylinders. No muffler, resonator, or other sound attenuating means is apparent, as is provided in the present catalytic converter and resonator combination invention.

Japanese Patent Publication No. 57-41414 published on Mar. 8, 1982 illustrates a method of manufacturing a catalytic converter equipped with a muffler. The assembly includes a forward muffler with a catalytic converter welded thereto and downstream thereof, with a rear muffler welded to the downstream end of the catalytic converter. The present catalytic converter and resonator combination utilizes a single, monolithic shell enclosing both the catalytic converter and resonator components, with no welding of separate components being required to form the housing or shell for the device. A "protector 37" (per the English abstract), apparently comprising an outer shell spaced apart from the inner housing containing the catalytic converter, is welded over the remainder of the assembly, unlike the present catalytic converter and resonator combination with its single shell or housing. No disclosure is apparent regarding any provision for a straight through, free flow resonator or removable end component, as provided by the present invention.

Japanese Patent Publication No. 62-291,413 published on Dec. 18, 1987 to Michio Hayashi describes (according to the drawings and English abstract) a muffler configuration having a series of longitudinally disposed tubes therein, with the tubes held in place by a pair of baffles or bulkheads. Hayashi stiffens the bulkheads by forming them of two sheets of material with a fill of sound deadening material, in order to preclude vibration at certain frequencies. However, Hayashi does not provide any V-shaped guides or the like, nor does he provide a double wall shell extending for the entire length of the device, catalytic converter element(s), removable end component, or other features of the present exhaust system invention.

Japanese Patent Publication No. 64-12,017 published on Jan. 17, 1989 to Yoji Nagai describes (according to the drawings and English abstract) a catalytic converter construction wherein the converter is formed of a corrugated plate, with the plate surfaces being coated with the catalytic material. The corrugated plate is then rolled to form a multitude of channels, through which the exhaust gases pass and are catalytically reacted. Such a catalytic converter construction is also disclosed in the '859 U.S. patent to Borla, discussed further above. While the present exhaust system invention may make use of such a catalytic converter construction, the '017 Japanese Patent Publication does not disclose the use of a double wall shell, removable end components, a catalytic converter in combination with other exhaust components, nor the specific internal construction of the present exhaust system invention.

Japanese Patent Publication No. 2-169,812 published on Jun. 29, 1990 to Yuichi Ito et al. describes (according to the drawings and English abstract) a muffler or the like wherein the outer shell is coated with a resin for rust and damage protection. Dual end caps are shown, but the outer outlet end cap and its attached exhaust pipe are not attached to the outlet tube of the device, which is held in place within the end of the exhaust pipe by the inner outlet end cap. This construction is quite different from that of any of the embodiments of the present invention. Moreover, while the '812 Japanese Patent Publication shows a series of internal tubes providing a sinusoidal flow path, there is no lateral gas flow between the tubes; all gases must flow from one end to the other sequentially, unlike the flow through the various embodiments of the present exhaust system invention. Such lateral flow and/or parallel flow paths are essential in a resonator type device, in order to separate and cancel various sound frequencies of the gases passing through the device. It is also noted that there is no provision for any form of V-shaped vanes or guides within the exhaust device of the '812 Japanese Patent Publication, whereas such internal vanes are a part of many of the embodiments of the present invention. Finally, the '812 Japanese Patent Publication does not appear to disclose any form of emissions treatment, such as the catalytic converter elements which are a part of most of the embodiments of the present invention.

European Patent Publication No. 475,398 published on Mar. 18, 1992 to Suzuki Kabushiki Kaisha, titled "Muffler Assembly For Engine," describes a device having double wall construction with a series of three concentric internal pipes. None of the pipes communicate directly with one another, and the inlet end of the outlet pipe is capped. All gas flow into and from the pipes is through peripheral holes formed in the pipes. While the '398 European Patent Publication discloses a double wall construction, no insulation or other material is placed between the two walls. Also, there is no disclosure of any form of catalytic converter element(s) within the exhaust device of the '398 European Patent Publication.

Japanese Patent Publication No. 6-257,421 published on Sep. 13, 1994 to Kohei Tomita describes (according to the drawings and English abstract) an exhaust device having a configuration very similar to that of the '413 Japanese Patent Publication, discussed further above. As in the case of the '413 Japanese Patent Publication, the '421 Japanese Patent Publication does not disclose any V-shaped guides or the like, nor does it disclose a double wall shell extending for the entire length of the device, catalytic converter element(s), removable end component, or other features of the present exhaust system invention.

Finally, Japanese Patent Publication No. 10-141,050 published on May 26, 1998 to Hiroshi Funahashi describes (according to the drawings and English abstract) a muffler and catalytic converter combination. The muffler portion is formed only of a single perforated inlet and single perforated outlet pipe, with the two pipes being concentric with one another and with the outer housing or shell. No baffle assembly or sinusoidal exhaust gas flow path is provided by the device of the '050 Japanese Patent Publication.

None of the above inventions and patents, taken either singly or in combination, is seen to describe the instant invention as claimed. Thus, exhaust sound and emission control systems solving the aforementioned problems is desired.

SUMMARY OF THE INVENTION

The exhaust sound and emission control systems of the present invention comprise a series of devices for attenuating sound and noxious emissions primarily for, but not limited to, an automobile exhaust system. In one aspect, the system relates to a catalytic converter and resonator combination, combined within a single canister or shell. The combination device may be installed between the engine and a muffler at or near the downstream or exhaust outlet end of the exhaust system, with the system perhaps including an additional catalytic converter(s) upstream of the catalytic converter and resonator combination. The placement of the catalytic converter and resonator combination forward of the muffler and tailpipe of the exhaust system, with the converter element forward of the resonator element, ensures that the converter portion of the combination will receive exhaust gases at a sufficiently high temperature to produce the desired catalytic reaction and thereby oxidize and/or reduce the exhaust components to harmless products. The catalytic converter element may be formed of a thin wall ceramic material, for further efficiency. Heated and/or electronic catalytic converter devices may be implemented to enhance emissions reduction.

The resonator portion of the combination is a straight through, free flow configuration, with all components being concentric to one another in the single exhaust configuration for greater efficiency. The resonator includes a central pipe with a plurality of relatively small holes or passages therethrough, for attenuating or canceling a relatively narrow band of frequencies produced by the engine exhaust. An alternative embodiment may include a dual exhaust version, with two side by side resonator pipes behind the catalytic converter portion, and either embodiment may include one or more catalytic converter elements therein.

As noted above, a resonator operates on the principle of canceling or impeding certain frequencies of sound within a relatively narrow band or range. The loudest sounds produced by various internal combustion engines will vary in frequency, depending upon the engine configuration (number of cylinders, cylinder layout, etc.), and other factors, including installation, etc. Accordingly, it is important to be able to adjust or tune a resonator for a given installation, in order to attenuate sounds within a predetermined range. The present combination catalytic converter and resonator invention may be structured to provide for such adjustment at the time of manufacture or assembly, as desired. Also, additional sound absorbing material may be installed within the device if desired, surrounding the inner resonator pipe or tube, to absorb sounds which might otherwise be transmitted through the outer shell of the device.

In another aspect, the system of the present invention comprises an exhaust sound attenuation and control system for use with internal combustion engines of any practicable type and configuration which combines the functions of a muffler and a resonator. In this aspect, the system generally comprises an outer shell containing multiple flow paths therein for exhaust gases, with the flow paths resulting in the canceling of certain frequencies of exhaust noise (i.e., acting as a resonator) and also lowering exhaust noise generally throughout the frequency range (i.e., acting as a muffler). Internal components of the present exhaust system may be coated with emissions reduction material in order to provide some limited catalyzing of exhaust emissions, as well.

In this regard, the system is configured so that the cross-sectional areas of the internal and outlet pipe passages are at least equal to, and are preferably greater than, the cross-sectional area of the inlet pipe. This provides relatively free flowing characteristics for the present system, thus reducing back pressure in the exhaust system and improving the efficiency of operation of the associated engine.

Such a system is relatively compact, particularly in comparison to the separate muffler and resonator systems of the prior art. The compact, integrated configuration of the present system enables it to be installed at virtually any location in the vehicle exhaust system. The system may be formed of high temperature resistant materials (e.g., corrosion resistant steel, etc.), as required, for installing adjacent to the vehicle engine. Additionally, the exterior and/or interior of the body may be covered with a ceramic jet coat or comparable thermal coating to retain internal temperature, significantly reducing the external temperature and creating more efficient emission reduction and enabling the unit to be in closer proximity to surrounding objects.

The system may be adapted for use as a single or multiple system, with crossover pipes as required. The crossover pipes may comprise a single pipe or a plurality of pipes between two or more exhaust control devices of the present invention, and may connect similar or dissimilar chambers or passages within the different devices, as desired, to enhance the versatility of the system.

In still another aspect, the system of the present invention essentially comprises a resonator and catalytic converter combination together with structural features associated with a muffler. In this configuration, the system incorporates a device with a series of internal tubes of different lengths and diameters, with exhaust flow being separated to pass through the various tubes. This results in the canceling of various frequencies, according to the resonance of a column of gas within each of the pipes. The device may also incorporate a series of V-shaped vanes or guides therein, and one or more catalytic converter elements. Any of the various components of any of the embodiments disclosed herein, may be combined where practicable with any of the other components of any of the other embodiments.

Accordingly, it is a principal object of the invention to provide an exhaust sound and emission control system which combines catalytic converter and resonator functions into a single device.

It is another object of the invention to provide an exhaust sound and emission control system for an internal combustion engine which includes a device that combines and includes features and functions of a muffler and resonator in a single device.

It is another object of the invention to provide an exhaust sound and emission control system having a resonator configuration incorporating a series of internal tubes of differing lengths and diameters from one another, for creating phase canceling resonant frequencies therein.

It is yet another object of the invention to provide an exhaust sound and emission control system having such a resonator configuration which may also include various baffles, guides, and/or catalytic converter elements, thereby combining catalytic converter, muffler and resonator functions into a single device.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an exhaust system for attenuating the sound, and optionally treating the emissions, of an internal combustion engine. The present exhaust system is more than just a muffler, and combines aspects of a muffler with aspects of a resonator unit as well. Optionally, the present system may incorporate catalytic materials for emissions treatment of the exhaust gases flowing therethrough, as noted above. Thus, the present exhaust treatment system provides a more compact, lighter weight, and more economical device for treating and controlling sound and other emissions of the exhaust of an internal combustion engine, replacing the multiple units required by conventional exhaust systems.

Figure 1:
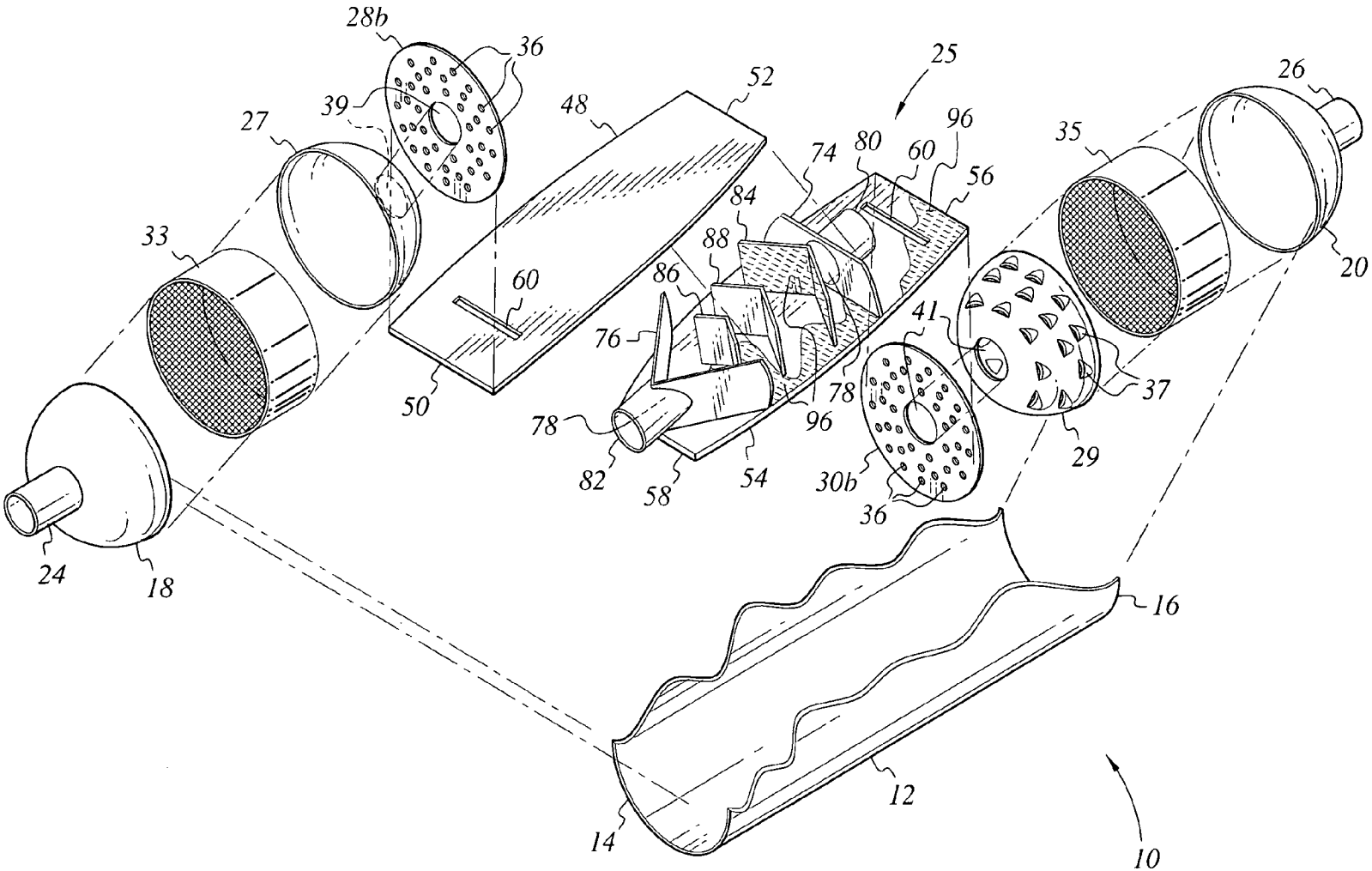
FIG. 1 is an exploded perspective view in partial section of a first embodiment of a single exhaust catalytic converter and resonator combination of the present invention, showing its structure and features.
Figure 2:
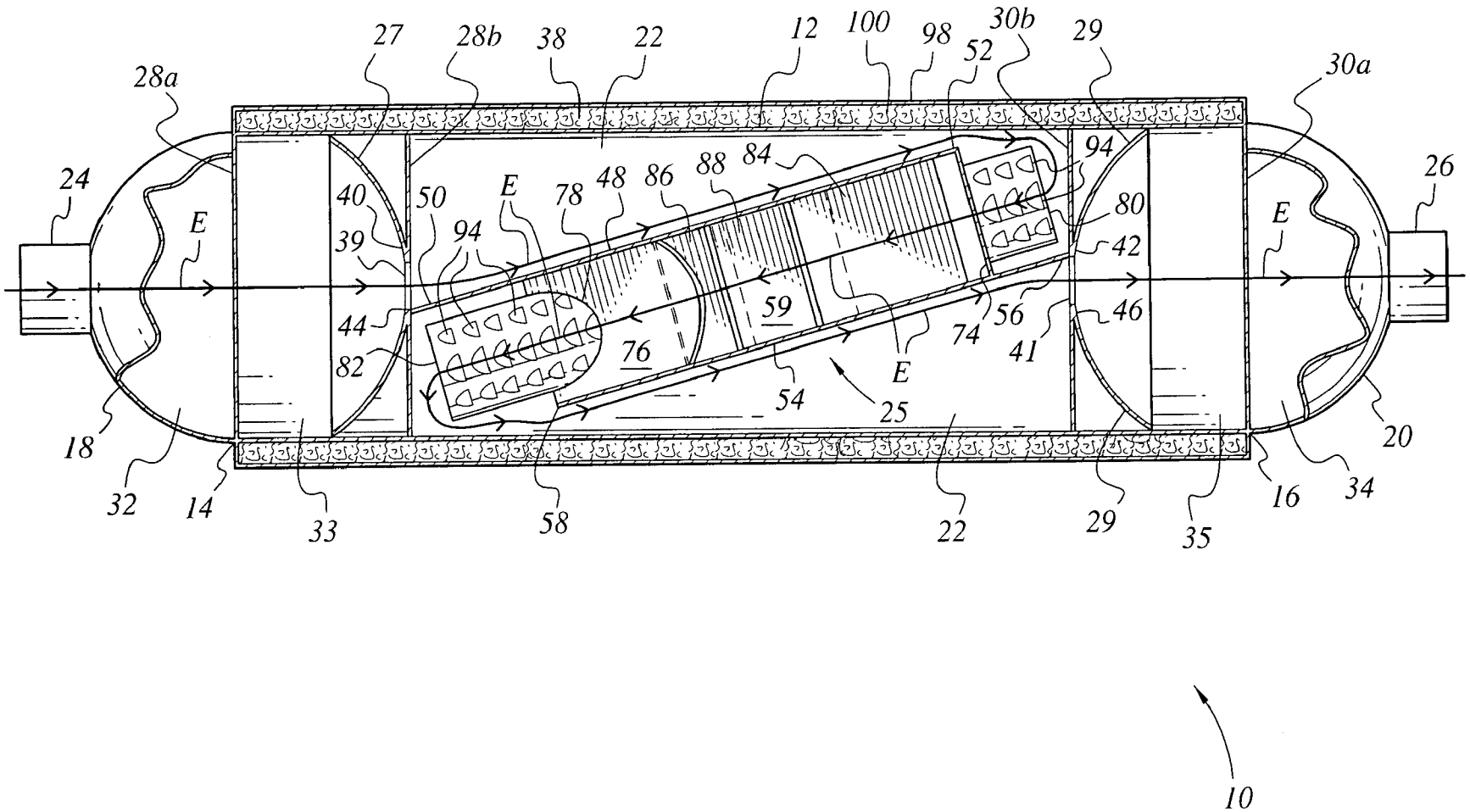
FIG. 2 is a side elevation view in section of the device of FIG. 1 showing the assembly of the components, and including further sound absorbing materials therein.

FIGS. 1 and 2 of the drawings provide exploded perspective and sectional views of a first embodiment 10 of the present exhaust system, comprising a generally cylindrical unit. The internal components of the exhaust system 10 are enclosed in an elongate external housing or shell 12 (shown with one side broken away in FIG. 1, for clarity in the drawing FIG.) having an inlet end 14 and opposite outlet end 16. Each end 14 and 16 of the housing 12 has an external end plate sealed thereto, respectively inlet end plate 18 and outlet end plate 20. These external end plates 18 and 20 may comprise opposed convex hemispherical shells, as shown, or may be flat or have some other shape, as desired. The additional internal volume of the illustrated convex hemispherical external end plates 18 and 20 may provide additional benefits, as discussed further below.

The external housing 12, external inlet end plate 18, and external outlet end plate 20 define an internal volume 22 (indicated in FIG. 2) which is sealed from the outer environment except for their respective inlet pipe 24 and outlet pipe 26. In the case of the hemispherical inlet and outlet plates 18 and 20, the inlet and outlet pipes 24 and 26 preferably penetrate their respective external inlet and outlet plates 18 and 20 to exit into respective inlet and outlet end chambers 32 and 34, further communicating at least indirectly with the interior volume 22 as described further below.

The central volume 22 of the exhaust system embodiment 10 includes a generally medially disposed exhaust baffle assembly 25, with exhaust gases traveling a generally sinusoidal exhaust gas path through the assembly 25, as indicated by the exhaust gas path arrow E. The extent of the internal baffle assembly 25 is defined by a baffle assembly inlet end plate 28*b* and an opposite baffle assembly outlet end plate 30*b*. Similar foraminous end plates 28*a* and 30*a* may be provided between the respective external end elements 18, 20 and the inlet and outlet ends 14 and 16 of the housing shell 12, as desired. Alternatively, the intermediate end plates 28*a* and 30*a* may comprise open rings, with their inner diameters matching the major diameters of the external end plates 18 and 20 and their outer diameters matching the diameter of a secondary outer shell 98, where implemented with the device. These baffle assembly inlet and outlet plates 28*b* and 30*b* respectively capture a concave, transverse internal inlet baffle 27 and opposite outlet baffle 29 immediately outboard thereof, with the external inlet end plate 18 and its nearby internal inlet baffle 27 defining an inlet catalytic converter chamber 32 therebetween and the opposite external outlet end plate 20 and its nearby internal outlet baffle 29 defining an outlet catalytic converter chamber 34 therebetween. Each of these chambers 32 and 34 may contain a catalytic converter element therein, e.g. inlet catalytic converter element 33 and outlet catalytic converter element 35. The two catalytic converter elements 33 and 35 span the entire diameter or width of the internal volume of their respective chambers 32 and 34, thereby requiring all exhaust gases to pass therethrough when the elements 33 and 35 are installed. Either the inlet element 33, or the outlet element 35, or both elements 33 and 35, may be installed within the exhaust system embodiment 10, as desired.

Each of the baffle assembly end plates 28*b* and 30*b* may include a series of perforations 36 therethrough, which allow exhaust gases to circulate into the inlet and outlet end volumes 32 and 34 of the system. It will also be noted that either or both of the internal end baffles 27 and 29 may be perforated (louvered, etc.), as shown in the exemplary internal outlet end baffle 29 in FIG. 1. These end volumes 32 and 34 may include some form of sound absorbent material 38 installed therein (shown in FIG. 2, e.g., glass fiber roving, etc.) to provide additional sound control, depending upon the sound level output of the engine, the size and sound control attributes of the remainder of the system, and the sound output level and quality desired. It will also be seen that the internal end plates 28*b* and 30*b* may be made considerably longer or thicker than shown in the drawings, and with their passages or perforations 36 coated internally with a catalytically reactive material, may provide a significant catalytic conversion effect when the system is modified to provide a net exhaust flow through the end volumes 32 and 34. Such catalytically modified internal end plates 28*b* and 30*b* may be installed in lieu of, or in addition to, the catalytic converter elements 33 and 35 illustrated in FIGS. 1 and 2.

While FIG. 1 illustrates the various components which comprise the present exhaust system 10, FIG. 2 provides an illustration of the exhaust gas flow paths which pass through the system 10. For the sake of reference to the installation positions of the various internal panels, plates, and baffles comprising the internal structure of the device 10, the inlet and exhaust passages 39 and 41 of the respective baffle assembly inlet and outlet end plates 28*b* and 30*b* and their respective joined internal inlet and outlet baffles 27 and 29 are considered to have a first side, respectively 40 and 42, and an opposite second side, respectively 44 and 46, indicated in FIG. 2 of the drawings. The diameter across the two sides 40,44 of the inlet passage 39 and sides 42, 46 of the outlet passage 41, define their respective cross-sectional areas. This is an important consideration for the flow of exhaust gases to, from, and through the present system 10, as discussed further below.

A first separator panel or baffle 48 has a first end 50 which is sealed across the internal inlet plate 28*b*, adjacent the second side 44 of the inlet passage 39. This first separator panel 48 is sloped relative to the longitudinal axis of the system 10, and extends angularly through the majority of the length of the housing 12 toward the internal wall of the housing 12, where it terminates at its second end 52. The second end 52 of the first separator panel 48 is spaced away from the internal surface of the housing 12, and defines a cross-sectional area therebetween. This cross-sectional area is in the form of a circular segment, and is at least as great as (or greater than) the cross-sectional area of the inlet pipe 24 and inlet passage 39.

A second separator panel 54 has a first end 56 which is sealed across the internal outlet plate 30*b*, adjacent the first side 42 of the outlet pipe 26. The second separator panel 54 is also sloped relative to the longitudinal axis of the system 10, and extends angularly through the majority of the length of the housing 12 toward the internal wall of the housing 12, where it terminates at its second end 58. The two separator panels 48 and 54 are preferably substantially parallel to one another, and define an exhaust gas intermediate chamber 59 therebetween, as discussed further below. The second end 58 of the second separator panel 54 is also spaced away from the internal surface of the housing 12 and defines a cross-sectional area therebetween, essentially like the cross-sectional area between the second end 52 of the first separator panel 48 and the wall or housing 12 of the assembly 10. As in the case of the first separator panel 48, the cross-sectional area between the second end 58 of the second separator panel 54 is also at least as great as (or greater than) the cross-sectional areas of the inlet and outlet pipes 24 and 26 and inlet and outlet passages 39 and 41. Either or both separator panels 48 and 54 may have smooth and planar surfaces, as shown, or may alternatively have irregular or roughened (e.g., corrugated, etc.) surfaces in order to increase their surface areas (to provide a greater reactive area if coated with a catalytic material) and/or to alter the gas flow through the device. This principle may be applied to similar components in other embodiments described herein.

Each of the two separator panels 48 and 54 may include a lateral exhaust gas pressure balance passage 60, which extends thereacross and near the respective first ends 50 and 56 of the two panels 48 and 54. These two pressure balance passages 60 provide alternative exhaust gas passages through the interior 22 of the system 10, with pressure pulses on each side of the panels 48 and 54 tending to cancel one another through the balance passages 60.

The above described layout of the separator panels or baffles 48 and 54 results in the inlet chamber 32, intermediate chamber 59, and outlet chamber 34 communicating with one another sequentially, as the exhaust gases flow from the inlet pipe 24 into the inlet chamber 32, through its catalytic converter element 33 and into the primary housing volume 22, through the gap between the second end 52 of the first separator panel 48 and the housing 12, back through the intermediate chamber 59, then through the gap between the second end 58 of the second separator panel 54 and the housing 12, through the primary housing volume 22 and into the outlet chamber 35 and its catalytic converter element 35, and finally out the outlet pipe 26. This sinusoidal primary exhaust gas pathway is preferably at least two and one half times the external length of the system 10, due to the lengths of the two separator panels 48 and 54 extending within the housing 12 for at least half of the length of the housing 12, along with the additional internal entry and exit pipes (discussed further below) for the intermediate passage area 59.

The intermediate chamber 59 further includes a series of generally lateral baffles or vanes thereacross, which serve to further attenuate the sound of the exhaust as it passes through the present system 10. Intermediate chamber entry and exit baffles, respectively 74 and 76, extend laterally across the entry and exit ends of the intermediate passage area 59. These baffles extend completely across the interior of the housing 12, extending from the second end 52 of the first separator panel 48 to the second separator panel 54 (for the entry baffle 74) and from the second end 58 of the second separator panel 54 to the first separator panel 48 (for the exit baffle 76), normal to the two panels 48 and 54.

These two baffles 74 and 76 seal the intermediate passage area 59, with the exception of their passages 78 through which all exhaust gases must pass to travel into and from the intermediate chamber 59. Each internal baffle passage 78 may include a supplementary pipe or resonator tube extending therefrom, with the entry baffle 74 having an internal entry pipe or tube 80 extending therefrom and toward the outlet end 16 of the system 10, and the exit baffle 76 having an exit pipe or tube 82 extending therefrom and toward the inlet end 14 of the system 10. These two internal pipes or tubes 80 and 82 add some additional length to the intermediate chamber 59 for further tuning effect, and serve to duct and guide the exhaust gases into and from the intermediate chamber 59. Either or both pipes or tubes 80 and/or 82 may have circular cross sections, as shown in FIG. 1, or may have some non-circular cross section(s), e.g. square or other regular or irregular polygonal shape, oval, ellipsoid, etc., as desired. Other embodiments described herein may also include these alternatives.

The intermediate chamber 59 further includes a series of generally chevron-shaped intermediate baffles or vanes extending between the two separator panels 48 and 54, and installed between the intermediate chamber entry and exit baffles 74 and 76. These baffles or vanes extend from a relatively wider first intermediate baffle 84 to a relatively narrower last intermediate baffle 86, with one or more secondary intermediate baffles 88 disposed therebetween. Each of these intermediate baffles 84 through 88 is oriented with the apex of the V facing the intermediate chamber entry baffle 74, and extends between the two separator panels 48 and 54. However, some lateral space is provided for exhaust gas flow around the ends of the intermediate baffles 84 through 88, with each of the baffles 84 through 88 having a narrower width from the entry baffle 74 toward the opposite exit baffle 76. Alternatively, the various intermediate baffles 84 through 88, and/or the entry and exit baffles 74 and/or 76, may have more generally swept shapes, with some lateral curvature at their central areas and/or extending to their lateral extremities, as desired. This alternative may also be provided for other embodiments of the present exhaust system disclosed herein.

The orientation of the V-shaped intermediate baffles or vanes 84 through 88 results in the pressure pulses of the exhaust gases flowing through the intermediate chamber 59, flowing around the lateral edges of the baffles 84 through 88 and tending to cancel therebetween. The various sizes of baffles 84 through 88 results in the canceling of a relatively broad spectrum or frequency range of exhaust noise. The internal entry pipe 80, which passes through the passage 78 of the first or entry baffle 74, serves to guide the exhaust gases toward the first intermediate baffle or vane 84, with that baffle 84 dividing the gases therearound to either side thereof. The V-shape of the final or exit baffle 76, is opposite the orientation of the intermediate baffles 84 through 88 and serves to collect the exhaust energy flowing from the intermediate chamber 59 and direct it from that chamber 59 by means of the exit passage 78 therethrough (shown in FIG. 2) and internal exit pipe 82 extending therefrom.

It will be noted that many of the other various panels and components, e.g., the two internal pipes 80 and 82, may also be provided with a series of perforations or passages 94 therethrough, as shown in FIG. 2. These passages 94 serve to guide some portion of the exhaust flow into other areas of the system 10, thereby providing alternative flow paths for exhaust gases flowing through the present exhaust system 10. This further breaks up the gases and their pressure pulses, thus further attenuating such pressure pulses and the corresponding noise produced by such pressure pulses.

The present exhaust system 10 may accomplish more than merely controlling the sound level of exhaust gases passing therethrough. Present technology incorporates separate catalytic converter elements for breaking down unburned hydrocarbons and oxides of nitrogen in exhaust gases, and the present exhaust sound and emission control system embodiments may also incorporate such catalytic converter elements, e.g. elements 33 and 35, as noted further above. In addition, the present system may also incorporate internal coatings 96 of emission reduction material therein if so desired, as shown in FIG. 1, e.g., platinum, rhodium, palladium, etc.

The relatively free flow characteristics of the present exhaust system result in a relatively small percentage of the exhaust gases actually contacting the internal surfaces of the device 10 (with the exception of the catalytic converter elements 33 and 35). However, coating the internal surfaces with a catalytic conversion coating 96 as shown in FIG. 1, e.g., the internal surface of the housing 12, the separator panels 48 and 54, the entry, exit, and intermediate baffles or vanes 84 through 88, etc., nevertheless does provide some additional reduction in exhaust emissions. (Not all surfaces are shown with the coating detail, for clarity in the drawing FIG.) Moreover, the two end internal plates **28*b* and 30*b* may be made thicker to incorporate a significant amount of catalytically reactive material within their internal passages 36, and the internal construction may be modified to route substantially all of the gases through the end chambers 32 and 34 and catalytic converter elements 33 and 35, as noted further above. Thus, the present exhaust system 10** may accomplish essentially all of the required functions of exhaust treatment in a single device, i.e., muffling the overall sound level, resonating certain frequencies, and catalytically treating the exhaust emissions.

Figure 3:
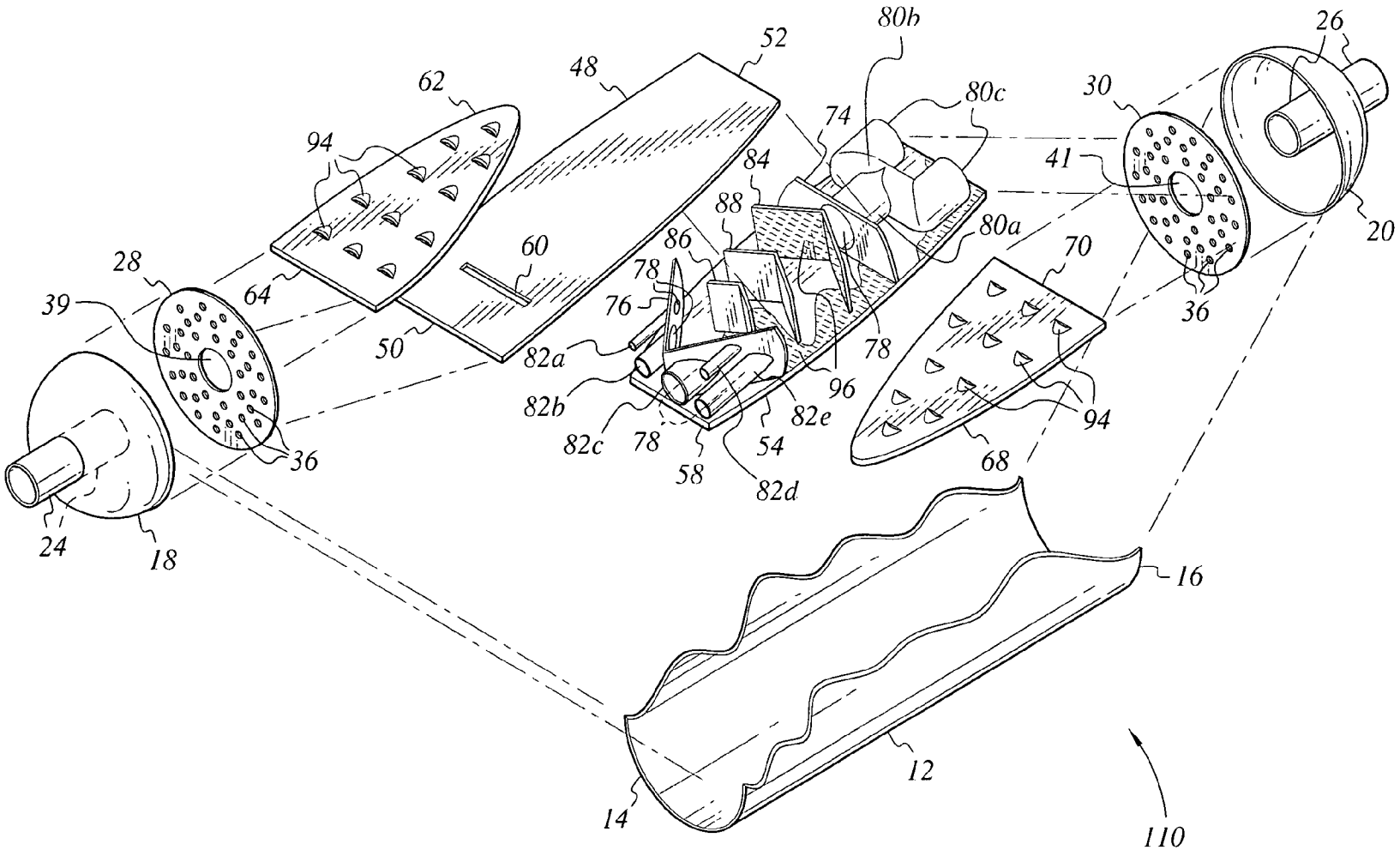
FIG. 3 is an exploded perspective view in partial section of an alternative embodiment of the single exhaust catalytic converter and resonator combination of FIG. 1, incorporating a series of resonator tubes or pipes therein.

FIG. 2 illustrates another variation which may be incorporated with the present exhaust system 10. In FIGS. 2 and 3, an additional, secondary or outer shell 98 is provided, surrounding the inner shell of the housing 12 and defining a housing volume 100 therebetween. The volume 100 therebetween may be filled with sound absorbent material 38 to quiet the present exhaust system 10 further, and/or the inner shell may be perforated, if so desired.

Figure 4:
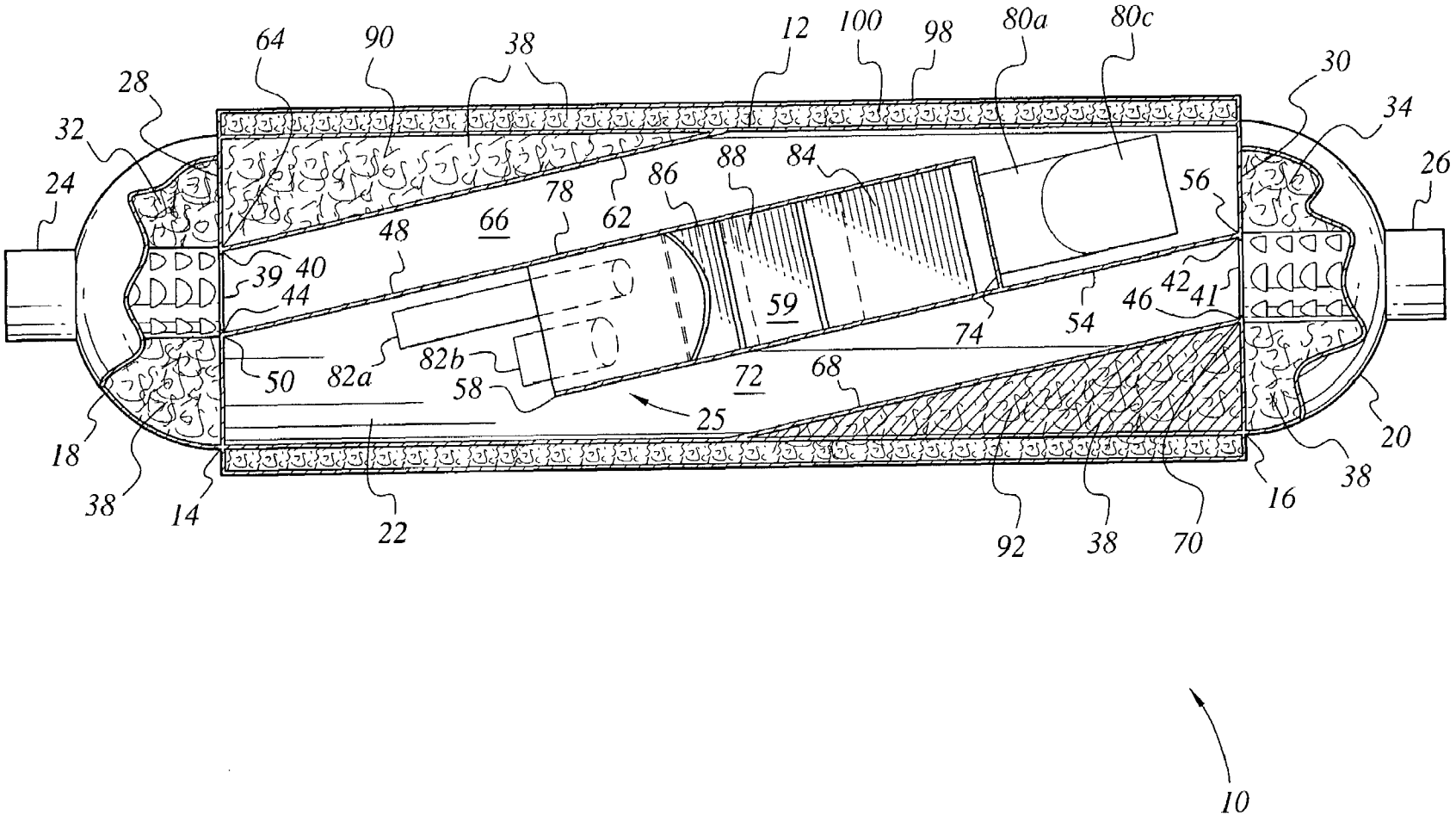
FIG. 4 is a side elevation view in section of the device of FIG. 3 showing the assembly of the components, and including further sound absorbing materials therein.

FIGS. 3 and 4 respectively provide an exploded perspective view and a side elevation view in section of another embodiment 110 of the present exhaust sound and emission control system invention. Like components between the embodiment 10 of FIGS. 1 and 2 and the embodiment 110 of FIGS. 3 and 4 are indicated with identical reference numerals, with only those components which are different between the two embodiments being indicated by different reference numerals.

The exhaust emission and control system device 110 of FIGS. 3 and 4 comprises a generally cylindrical unit. The internal components of the exhaust system 110 are enclosed in an elongate external housing or shell 12 (shown with one side broken away in FIG. 3, for clarity in the drawing FIG.) having an inlet end 14 and opposite outlet end 16. Each end 14 and 16 of the housing 12 has an external end plate sealed thereto, respectively inlet end plate 18 and outlet end plate 20. These external end plates 18 and 20 may comprise opposed convex hemispherical shells, as shown, or may be flat or have some other shape, as desired. The additional internal volume of the illustrated convex hemispherical external end plates 18 and 20 may provide additional benefits, as discussed further below.

The external housing 12, external inlet end plate 18, and external outlet end plate 20 define an internal volume 22 (indicated in FIG. 4) which is sealed from the outer environment except for their respective inlet pipe 24 and outlet pipe 26. In the case of the hemispherical inlet and outlet plates 18 and 20, the inlet and outlet pipes 24 and 26 preferably penetrate their respective external inlet and outlet plates 18 and 20 to pass through respective inlet and outlet end chambers 32 and 34, further communicating at least indirectly with the interior volume 22 as described further below.

The central volume 22 of the exhaust system embodiment 110 includes a generally medially disposed exhaust baffle assembly 25, with exhaust gases traveling a generally sinusoidal exhaust gas path through the assembly 25, similar to the exhaust gas path arrow E shown in the embodiment 10 of FIG. 2. The extent of the internal baffle assembly 25 is defined by the overlapping portions of parallel first and second separator panels 48 and 54, discussed in detail further below.

Each of the baffle assembly end plates 28 and 30 may include a series of perforations 36 therethrough, which allow exhaust gases to circulate into the inlet and outlet end volumes 32 and 34 of the system. These end volumes 32 and 34 may include some form of sound absorbent material 38 installed therein (shown in FIG. 4, e.g., glass fiber roving, etc.) to provide additional sound control, depending upon the sound level output of the engine, the size and sound control attributes of the remainder of the system, and the sound output level and quality desired. It will also be seen that the internal end plates 28 and 30 may be made considerably longer or thicker than shown in the drawings, and with their passages or perforations 36 coated internally with a catalytically reactive material, may provide a significant catalytic conversion effect when the system is modified to provide a net exhaust flow through the end volumes 32 and 34.

While FIG. 3 illustrates the various components which comprise the present exhaust system 110, FIG. 4 provides an illustration of the exhaust gas flow paths which pass through the system 110. For the sake of reference to the installation positions of the various internal panels, plates, and baffles comprising the internal structure of the device 110, the inlet and exhaust passages 39 and 41 of the respective baffle assembly inlet and outlet end plates 28 and 30 are considered to have a first side, respectively 40 and 42, and an opposite second side, respectively 44 and 46, indicated in FIG. 4 of the drawings. The diameter across the two sides 40, 44 of the inlet passage 39 and sides 42, 46 of the outlet passage 41, define their respective cross-sectional areas. This is an important consideration for the flow of exhaust gases to, from, and through the present system 110, as discussed further below.

A first separator panel or baffle 48 has a first end 50 which is sealed across the internal inlet plate 28, adjacent the second side 44 of the inlet passage 39. This first separator panel 48 is sloped relative to the longitudinal axis of the system 10, and extends angularly through the majority of the length of the housing 12 toward the internal wall of the housing 12, where it terminates at its second end 52. The second end 52 of the first separator panel 48 is spaced away from the internal surface of the housing 12, and defines a cross-sectional area therebetween. This cross-sectional area is in the form of a circular segment, and is at least as great as (or greater than) the cross-sectional area of the inlet pipe 24 and inlet passage 39.

A second separator panel 54 has a first end 56 which is sealed across the internal outlet plate 30, adjacent the first side 42 of the outlet pipe 26. The second separator panel 54 is also sloped relative to the longitudinal axis of the system 110, and extends angularly through the majority of the length of the housing 12 toward the internal wall of the housing 12, where it terminates at its second end 58. The two separator panels 48 and 54 are preferably substantially parallel to one another, and define an exhaust gas intermediate chamber 59 therebetween, as discussed further below. The second end 58 of the second separator panel 54 is also spaced away from the internal surface of the housing 12 and defines a cross-sectional area therebetween, essentially like the cross-sectional area between the second end 52 of the first separator panel 48 and the wall or housing 12 of the assembly 110. As in the case of the first separator panel 48, the cross-sectional area between the second end 58 of the second separator panel 54 is also at least as great as (or greater than) the cross-sectional areas of the inlet and outlet pipes 24 and 26 and inlet and outlet passages 39 and 41.

Each of the two separator panels 48 and 54 may include a lateral exhaust gas pressure balance passage 60, which extends thereacross and near the respective first ends 50 and 56 of the two panels 48 and 54. These two pressure balance passages 60 provide alternative exhaust gas passages through the interior 22 of the system 110, with pressure pulses on each side of the panels 48 and 54 tending to cancel one another through the balance passages 60.

A first supplementary panel 62 has a first end 64 which is sealed across the internal surface of the inlet end plate 18 (or to its associated internal plate 28) adjacent the first side 40 of the inlet pipe 24, and extends angularly through substantially the first half of the length of the system 110. The outer edge of the supplementary panel 62 forms a parabolic curve, in keeping with its juncture with the cylindrical internal surface of the housing 12. It will be seen that the supplementary panel 62 may have any suitable peripheral shape adapted to mate closely with and seal along the internal surface of the housing 12, depending upon the shape of the housing 12. The first supplementary panel 62 is preferably parallel to the first separator panel 48, and along with the housing 12 walls, defines an exhaust gas inlet chamber 66 therebetween, as shown in the side elevation in section of FIG. 4.

A second supplementary panel 68 has a first end 70 sealed across the internal surface of the outlet end plate 20, or to its associated internal plate 30, adjacent the second side 46 of the outlet pipe 26, and extends angularly through substantially the second half of the length of the system 110. The outer edge of the second supplementary panel 68 is also sealed along the internal wall of the housing or shell 12, similarly to the first supplementary panel 62. The second supplementary panel 68 is preferably parallel to the second separator panel 54, and along with the housing 12 walls, defines an exhaust gas outlet chamber 72 therebetween.

The above described layout of the various panels or baffles 48, 54, 62, and 68 results in the inlet chamber 66, intermediate chamber 59, and outlet chamber 72 communicating with one another sequentially, as the exhaust gases flow from the inlet pipe 24 into the inlet chamber 66, through the gap between the second end 52 of the first separator panel 48 and the housing 12, back through the intermediate chamber 59, then through the gap between the second end 58 of the second separator panel 54 and the housing 12, through the outlet chamber 72, and finally out the outlet pipe 26. This sinusoidal primary exhaust gas pathway is at least two and one half times the external length of the system 10, due to the lengths of the two separator panels 48 and 54 extending within the housing 12 for some three quarters of the length of the housing 12, along with the additional internal entry and exit pipes (discussed further below) for the intermediate passage area 59.

The intermediate chamber 59 further includes a series of generally lateral baffles or vanes thereacross, which serve to further attenuate the sound of the exhaust as it passes through the present system 110. Intermediate chamber entry and exit baffles, respectively 74 and 76, extend laterally across the entry and exit ends of the intermediate passage area 59. These baffles extend completely across the interior of the housing 12, extending from the second end 52 of the first separator panel 48 to the second separator panel 54 (for the entry baffle 74) and from the second end 58 of the second separator panel 54 to the first separator panel 48 (for the exit baffle 76), normal to the two panels 48 and 54.

These two baffles 74 and 76 seal the intermediate passage area 59, with the exception of their passages 78 through which all exhaust gases must pass to travel into and from the intermediate chamber 59. Each internal baffle passage 78 may include one or more supplementary pipes or resonator tubes extending therefrom. In the example of FIGS. 3 and 4, the entry baffle 74 has a single internal entry pipe or tube 80*a* extending therefrom and toward the outlet end 16 of the system 10, with a lateral tube or pipe 80*b* (shown in FIG. 3) extending therefrom. A pair of opposed branch tubes or pipes 80*c* extend from the ends of the lateral pipe 80*b*. The opposite exit baffle 76 includes a series of exit pipes or tubes 82*a* through 82*e* extending therefrom and toward the inlet end 14 of the system 10. The exit pipes or tubes 82*a* through 82*e* may be of various lengths, diameters, cross sectional shapes, and locations from the exit baffle 76, depending upon the precise frequencies which must be attenuated by the resonator properties of the tubes. These two internal pipe or tube assemblies 80 and 82 add some additional length to the intermediate chamber 59 for further tuning effect, and serve to duct and guide the exhaust gases into and from the intermediate chamber 59.

The intermediate chamber 59 further includes a series of generally chevron-shaped intermediate baffles or vanes extending between the two separator panels 48 and 54, and installed between the intermediate chamber entry and exit baffles 74 and 76. These baffles or vanes extend from a relatively wider first intermediate baffle 84 to a relatively narrower last intermediate baffle 86, with one or more secondary intermediate baffles 88 disposed therebetween. Each of these intermediate baffles 84 through 88 is oriented with the apex of the V facing the intermediate chamber entry baffle 74, and extends between the two separator panels 48 and 54. However, some lateral space is provided for exhaust gas flow around the ends of the intermediate baffles 84 through 88, with each of the baffles 84 through 88 having a narrower width from the entry baffle 74 toward the opposite exit baffle 76.

The orientation of the V-shaped intermediate baffles or vanes 84 through 88 results in the pressure pulses of the exhaust gases flowing through the intermediate chamber 59, flowing around the lateral edges of the baffles 84 through 88 and tending to cancel therebetween. The various sizes of baffles 84 through 88 results in the canceling of a relatively broad spectrum or frequency range of exhaust noise. The internal entry pipe 80*a*, which passes through the passage 78 of the first or entry baffle 74, serves to guide the exhaust gases toward the first intermediate baffle or vane 84, with that baffle 84 dividing the gases therearound to either side thereof. The V-shape of the final or exit baffle 76, is opposite the orientation of the intermediate baffles 84 through 88 and serves to collect the exhaust energy flowing from the intermediate chamber 59 and direct it from that chamber 59 by means of the exit passage 78 therethrough (shown in FIG. 4) and internal exit pipe 82 extending therefrom.

It will be noted that the two supplementary panels 62 and 68, along with the adjacent areas of the external housing 12, define first and second supplementary volumes 90 and 92 in the device 110. The two supplementary panels 62 and 68 are provided with a series of perforations or passages 94 therethrough, which allow the pressure pulses of the exhaust gases to flow into the supplementary volumes 90 and 92, at least to some extent. This provides further frequency cancellation of exhaust noises and sounds in the present exhaust system 110. These passages 94 may be in the form of semicircular arcs, as shown, or some alternative shape as desired.

It will be noted that many of the other various panels and components, e.g., the two internal pipe assemblies 80 and 82, may also be provided with a series of perforations or passages 94 therethrough, as shown in FIG. 2. These passages 94 serve to guide some portion of the exhaust flow into other areas of the system 110, thereby providing alternative flow paths for exhaust gases flowing through the present exhaust system 110. This further breaks up the gases and their pressure pulses, thus further attenuating such pressure pulses and the corresponding noise produced by such pressure pulses.

It will be seen that the present exhaust sound and emission control system embodiment 110 may also incorporate such catalytic converter elements, e.g. elements 33 and 35, as shown in the embodiment 10 of FIGS. 1 and 2 and described further above. In addition, the present system 110 may also incorporate internal coatings 96 of emission reduction material therein if so desired, as shown in FIG. 3, e.g., platinum, rhodium, palladium, etc.

The relatively free flow characteristics of the present exhaust system result in a relatively small percentage of the exhaust gases actually contacting the internal surfaces of the device 110 (with the exception of the catalytic converter elements 33 and 35, if incorporated therewith). However, coating the internal surfaces with a catalytic conversion coating 96 as shown in FIG. 3, e.g., the internal surface of the housing 12, the separator panels 48 and 54, the entry, exit, and intermediate baffles or vanes 84 through 88, etc., nevertheless does provide some additional reduction in exhaust emissions. (Not all surfaces are shown with the coating detail, for clarity in the drawing FIG.) Moreover, the two end internal plates 28 and 30 may be made thicker to incorporate a significant amount of catalytically reactive material within their internal passages 36, and the internal construction may be modified to route substantially all of the gases through the end chambers 32 and 34 and catalytic converter elements 33 and 35, as noted further above. Thus, the present exhaust system 110 may accomplish essentially all of the required functions of exhaust treatment in a single device, i.e., muffling the overall sound level, resonating certain frequencies, and catalytically treating the exhaust emissions.

FIG. 4 illustrates another variation which may be incorporated with the present exhaust system 110. In FIG. 4, an additional, secondary or outer shell 98 is provided, surrounding the inner shell of the housing 12 and defining a housing volume 100 therebetween. The volume 100 therebetween may be filled with sound absorbent material 38 to quiet the present exhaust system 10 further, and/or the inner shell may be perforated, if so desired.

Figure 5:
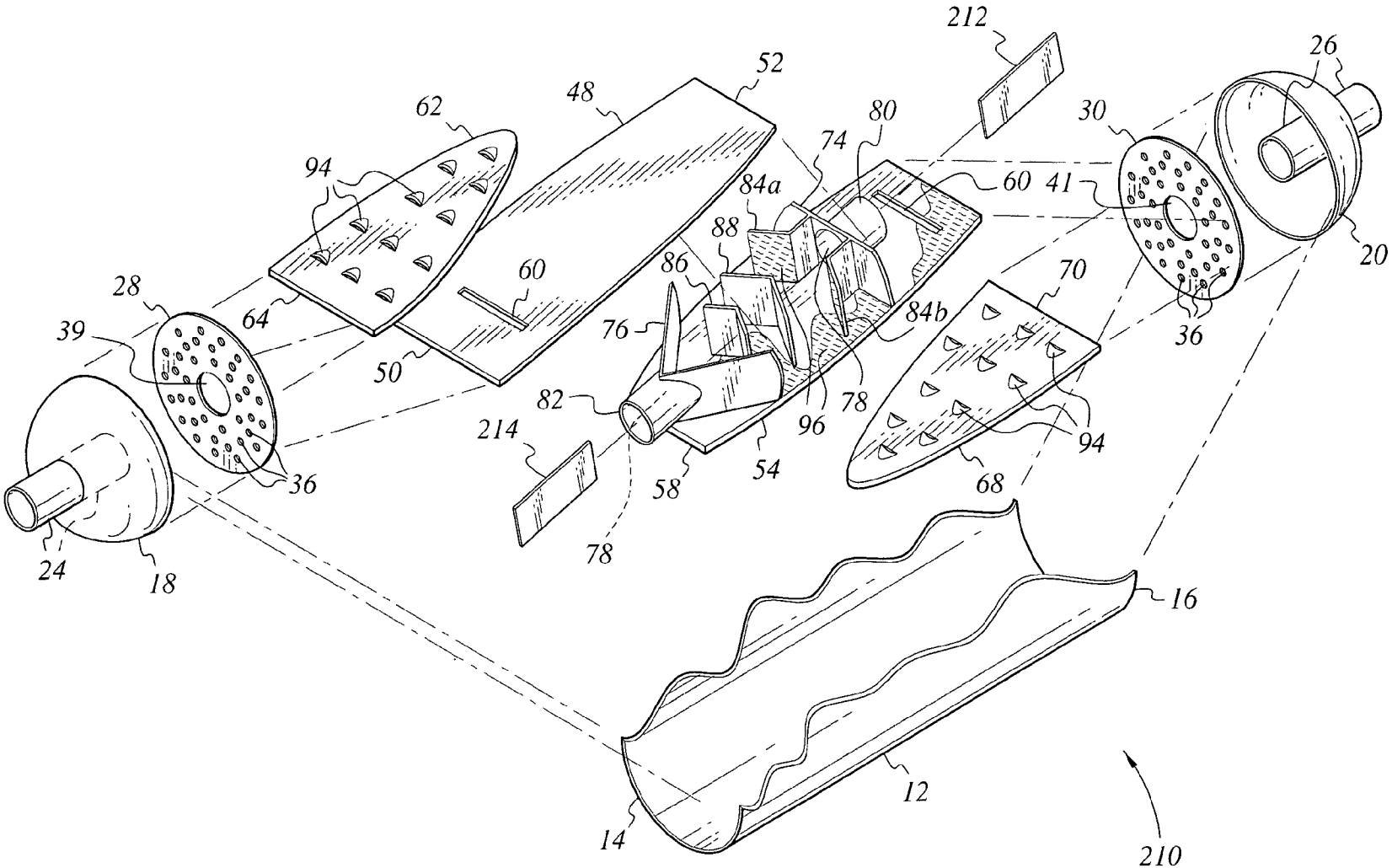
FIG. 5 is an exploded perspective view in partial section of a further alternative embodiment of the device of FIG. 1, incorporating an alternative internal baffle configuration.
Figure 6:
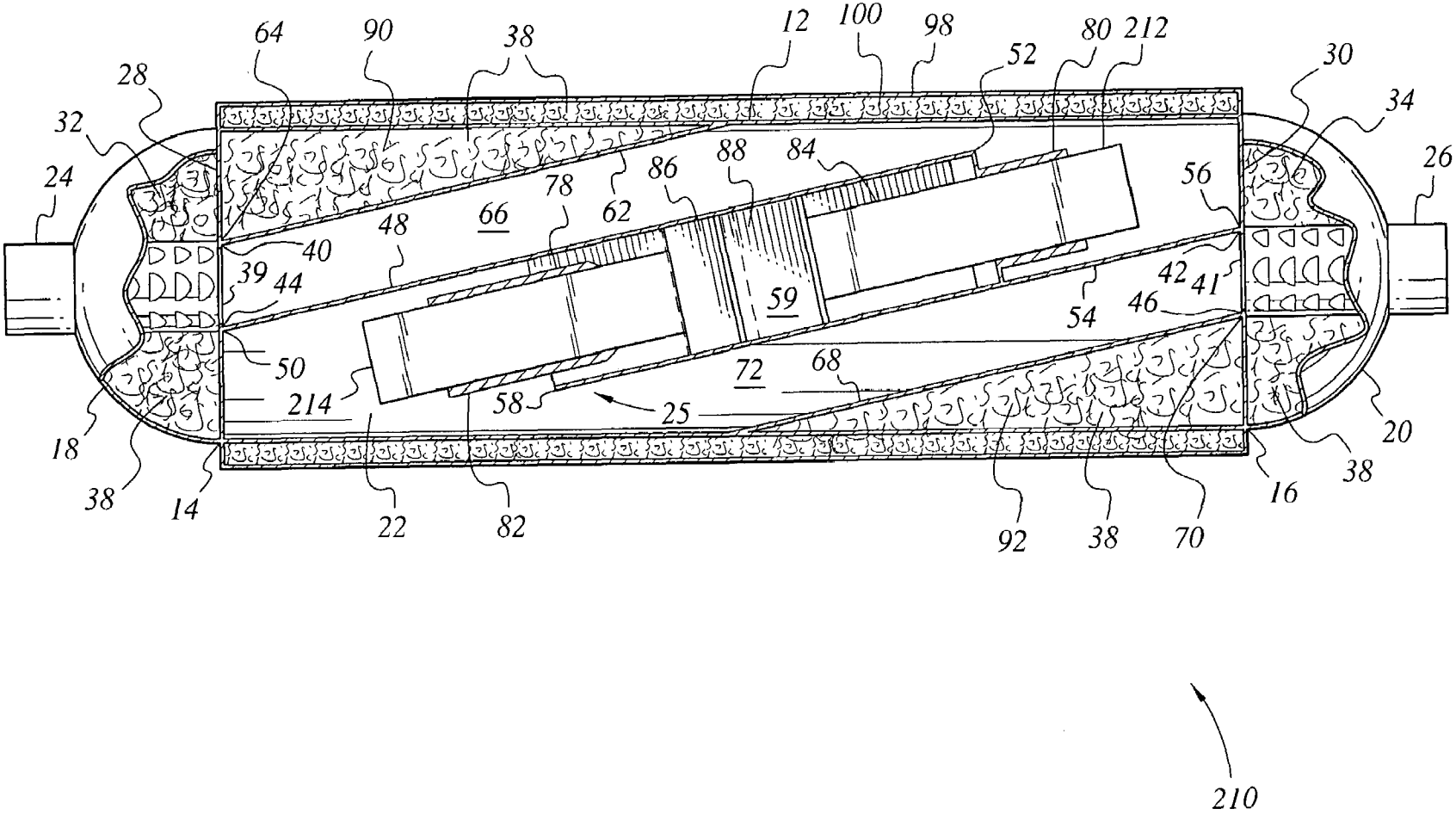
FIG. 6 is a side elevation view in section of the device of FIG. 5 showing the assembly of the components, and including further sound absorbing materials therein.

FIGS. 5 and 6 respectively provide an exploded perspective view and a side elevation view in section of yet another embodiment 210 of the present exhaust sound and emission control system invention. Like components between the embodiment 10 of FIGS. 1 and 2 and the embodiment 210 of FIGS. 5 and 6 are indicated with identical reference numerals, with only those components which are different between the two embodiments being indicated by different reference numerals. Those like components need not be described in detail for the embodiment 210 of FIGS. 5 and 6. Generally, the embodiment 210 is related to the embodiment 110 of FIGS. 3 and 4, in that the embodiment 210 does not include additional catalytic converter elements 33 and 35 (although they could be installed in the embodiment 210, if so desired).

The embodiment 210 differs from the embodiment 110 in the areas of the internal chamber entry and exit baffles or upstream and downstream guides 74 and 76, and the second upstream baffle or guide. It will be seen in FIGS. 5 and 6 that the second upstream baffle or guide is actually formed as two separate sides or components 84*a* and 84*b*, with each component being on an opposite side of the resonator tube passage 78 through the entry baffle or guide 74. The two baffle or guide components 84*a* and 84*b* may extend upstream and join to the entry baffle or guide 74, to each side of the exhaust resonator tube passage 78 therethrough, as indicated by the broken line portions of each baffle component 84*a* and 84*b*. Alternatively, the baffle components 84*a* and 84*b* may be separated from the entry baffle or guide 74, if the broken line portions of each baffle component 84*a* and 84*b* are removed.

Moreover, an upstream and a downstream divider vane, respectively 212 and 214, are installed through the respective entry and exit pipes or tubes 80 and 82 in the embodiment 210 of FIGS. 5 and 6. These divider vanes 212 and 214 have lengths approximately equal to their respective tubes 80 and 82, and serve to smooth and separate the exhaust gas flow relative to the two sides of the series of chevron shaped baffles or guides 76, 86, and 88. Accordingly, the upstream divider vane 212 may extend between the two sides of the separate guide components 84*a* and 84*b* to the secondary intermediate baffle or guide 88, to preclude turbulent flow due to gases passing from one side of the assembly to the other.

Figure 7:
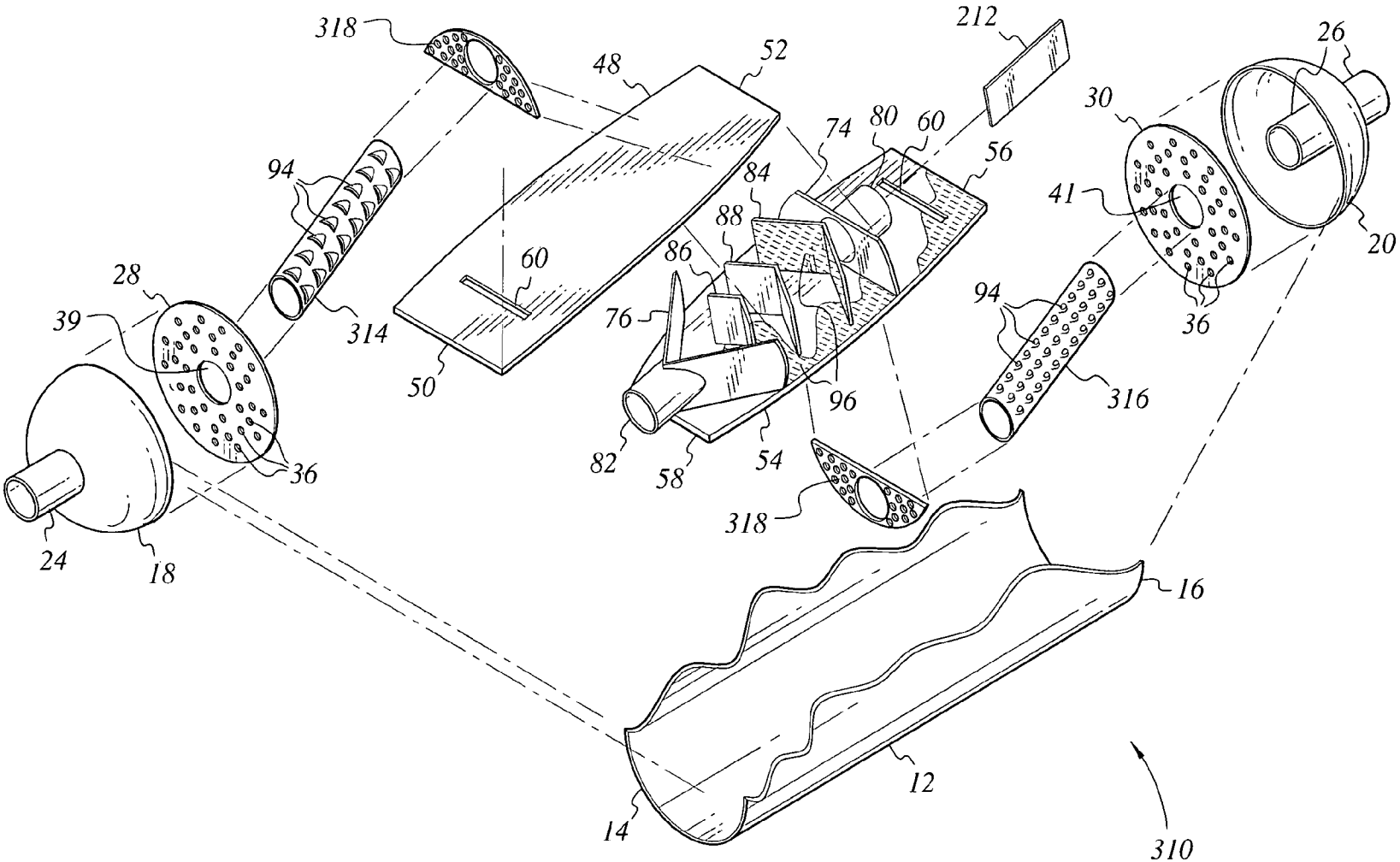
FIG. 7 is an exploded perspective view in partial section of a further alternative embodiment of the device of FIG. 1, incorporating an alternative internal flow tube configuration.
Figure 8:
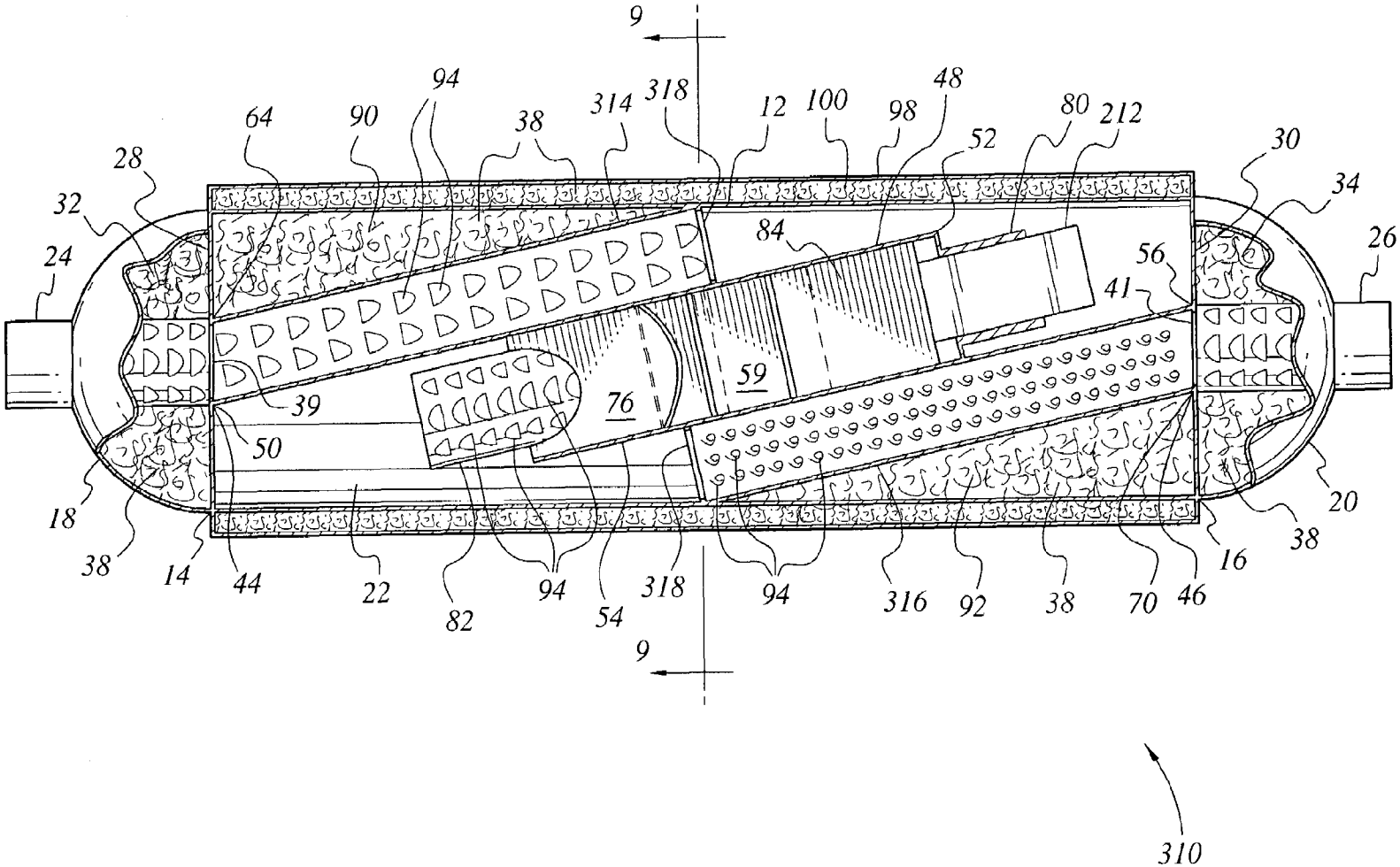
FIG. 8 is a side elevation view in section of the device of FIG. 7 showing the assembly of the components, and including further sound absorbing materials therein.
Figure 9:
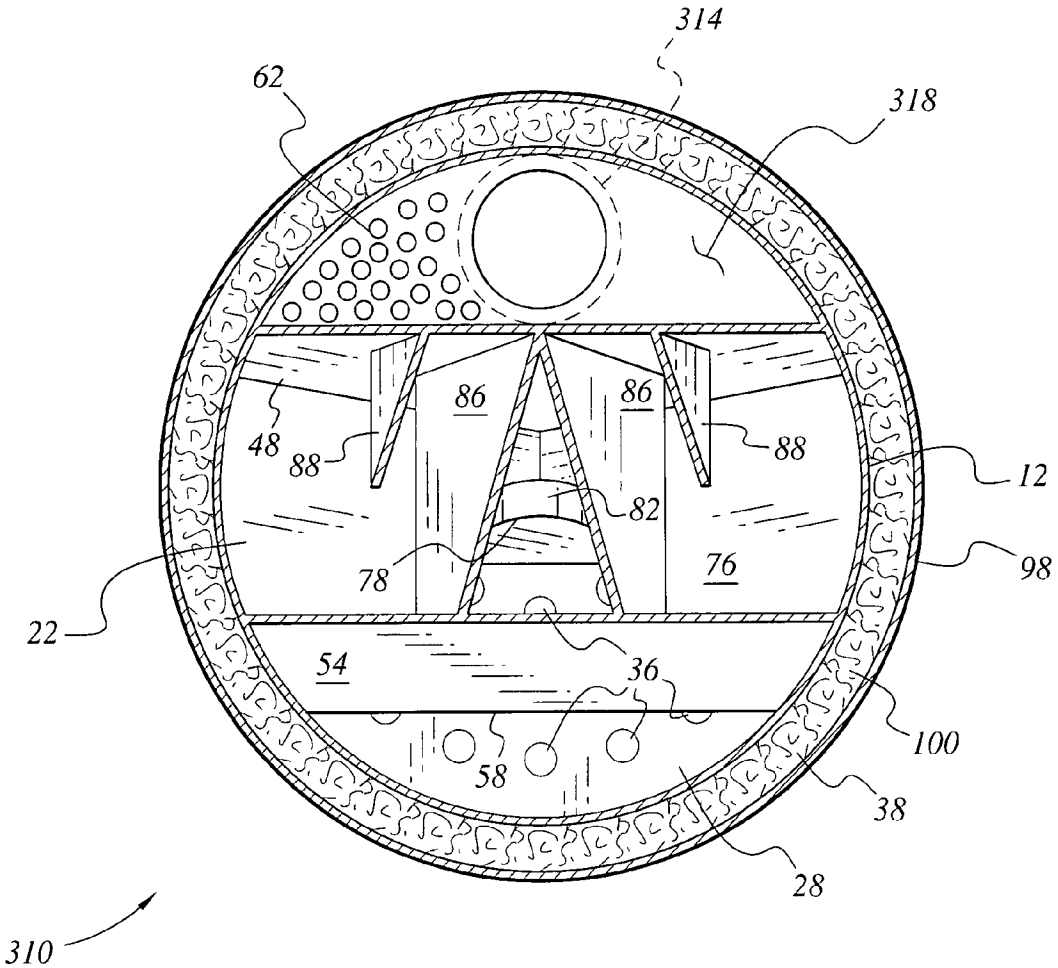
FIG. 9 is an end elevation view in section through line 9-9 of FIG. 8, showing further details of the relationship of the internal components of the device.

FIGS. 7 through 9 respectively provide an exploded perspective view, a side elevation view in section, and a lateral view in section through line 9-9 of FIG. 8, of yet another embodiment 310 of the present exhaust sound and emission control system invention. Like components between the embodiment 10 of FIGS. 1 and 2 and the embodiment 310 of FIGS. 7 through 9 (and other embodiments) are indicated with identical reference numerals, with only those components which are different between the different embodiments being indicated by different reference numerals. As in the case of the embodiment 210 of FIGS. 5 and 6, those like components need not be described in detail for the embodiment 310 of FIGS. 7 through 9. Generally, the embodiment 210 is related to the embodiment 110 of FIGS. 3 and 4, in that the embodiment 310 does not include additional catalytic converter elements 33 and 35 (although they could be installed in the embodiment 310, if so desired).

The embodiment 310 differs from other embodiments, particularly the embodiment 210 of FIGS. 5 and 6, in the volumes of the exhaust gas inlet and outlet chambers 66 and 74 and first and second supplementary volumes 90 and 92 of the embodiment 210. In the embodiment 310, inlet and outlet volume tubes, respectively 314 and 316, extend from their respective openings or passages 39 and 41 through the inlet and outlet end plates 28 and 30, adjacent and parallel to the two separator panels 48 and 54. These tubes 314 and 316 serve to guide the exhaust gas flow into the system 310, and include perforations, louvers, and/or other lateral passages 94 therethrough, through which the exhaust gases pass to enter the interior volume of the system 310. A semicircular (or other congruent shape) end plate 318 is installed between the inner shell or housing 12 and the corresponding separator panel 48 or 54 and across the end of the respective tube 314 or 316, to support the ends of the tubes 314 and 316. These end plates 318 may be solid (excepting the flow through passage for each tube 314 and 316), or may be foraminous, as is optionally provided in various other internal components of the present exhaust system embodiments. (Only one side of the plate 318 is shown with perforations in FIG. 9, to show the two alternatives.)

In conclusion, the present exhaust sound and emission control systems greatly reduce the volume and mass required for exhaust control devices, by incorporating all of the required components into a single device. The present systems in their various embodiments provide a number of variations on earlier devices developed by the present inventor, with these variations providing further exhaust sound and emission control for various vehicle and engine combinations. Accordingly, the present exhaust systems in their various embodiments will prove to be most valuable components for installation both as original equipment or as aftermarket devices.

It is to be understood that the present invention is not limited to the embodiments described above, but encompasses any and all embodiments within the scope of the following claims.

I claim:

1. An exhaust sound and emission control system, comprising:

an elongate external housing having a housing wall, an exhaust inlet end, and an exhaust outlet end opposite the exhaust inlet end;

a convex external inlet end plate and a convex external outlet end plate, respectively secured to and sealing the inlet end and the outlet end of said housing and defining an interior volume therein;

an inlet pipe and an outlet pipe, respectively penetrating and extending from said external inlet end plate and from said external outlet end plate and communicating with the interior volume;

an exhaust baffle assembly disposed generally medially within the interior volume, and defining a sinusoidal exhaust gas path;

at least one concave, transverse internal baffle disposed between said exhaust baffle assembly and one said convex external end plate, and defining a catalytic converter chamber therebetween; and at least one catalytic converter element disposed between said exhaust baffle assembly and one said convex external end plate, and extending completely across the catalytic converter chamber.

2. The exhaust sound and emission control system according to claim 1, wherein said at least one catalytic converter element is disposed between said external inlet end plate and said exhaust baffle assembly.

3. The exhaust sound and emission control system according to claim 1, wherein said at least one catalytic converter element is disposed between said external outlet end plate and said exhaust baffle assembly.

4. The exhaust sound and emission control system according to claim 1, wherein said at least one catalytic converter element comprises:

an inlet end catalytic converter element disposed between said external inlet end plate and said exhaust baffle assembly; and an outlet end catalytic converter element disposed between said external outlet end plate and said exhaust baffle assembly.

5. The exhaust sound and emission control system according to claim 1, wherein said exhaust baffle assembly comprises:

a baffle assembly inlet end plate disposed across the interior volume of said housing, near said external inlet end plate;

a baffle assembly outlet end plate disposed across the interior volume of said housing, near said external outlet end plate;

each said baffle assembly end plate further including a centrally disposed exhaust gas passage therethrough, with each exhaust gas passage having a first side and a second side opposite the first side;

a first separator panel extending from the first side of the baffle assembly inlet end plate exhaust gas passage, sloping toward the opposite side of the housing wall and extending laterally across the housing wall, defining a baffle inlet volume between said first separator panel, said baffle assembly inlet end plate, and the housing wall;

a second separator panel extending from the second side of the baffle assembly outlet end plate exhaust gas passage, sloping toward the opposite side of the housing wall and extending laterally across the housing wall and disposed parallel to said first separator panel, defining a baffle outlet volume between said second separator panel, said baffle assembly outlet end plate, and the housing wall;

a plurality of transverse guides extending between said first separator panel and said second separator panel, and normal thereto;

at least one of said transverse guides further including a resonator tube passage therethrough; and at least one resonator tube extends from the resonator tube passage thereof.

6. The exhaust sound and emission control system according to claim 5, wherein:

said plurality of transverse guides further includes at least a first upstream guide and a second upstream guide;

said second upstream guide further including a first side and a second side separate therefrom;

the first side and the second side of said second upstream guide joining said first upstream guide to each side of the resonator tube passage thereof; and a divider vane extends between each side of said second upstream guide, through the resonator tube passage of said first upstream guide, and through said at least one resonator tube.

7. The exhaust sound and emission control system according to claim 1, further including:

an internal inlet end plate disposed across the interior volume of said housing, near said convex inlet end plate;

an internal outlet end plate disposed across the interior volume of said housing, near said convex outlet end plate;

each said internal end plate further including a centrally disposed exhaust gas passage therethrough, with each exhaust gas passage having a first side and a second side opposite the first side;

a first separator panel extending from the first side of the internal inlet end plate exhaust gas passage, sloping toward the opposite side of the housing wall and extending laterally across the housing wall, defining a baffle inlet volume between said first separator panel, said internal inlet end plate, and the housing wall;

a second separator panel extending from the second side of the internal outlet end plate exhaust gas passage, sloping toward the opposite side of the housing wall and extending laterally across said housing wall and disposed parallel to said first separator panel, defining a baffle outlet volume between said second separator panel, said internal outlet end plate, and the housing wall;

an inlet volume tube extending from the exhaust gas passage of said internal inlet end plate toward the housing wall, and immediately adjacent said first separator panel; and an outlet volume tube extending from the exhaust gas passage of said internal outlet end plate toward the housing wall, and immediately adjacent said second separator panel.

8. An exhaust sound and emission control system, comprising:

an elongate external housing having a housing wall, an exhaust inlet end, and an exhaust outlet end opposite the exhaust inlet end;

a convex inlet end plate and a convex outlet end plate, respectively secured to and sealing the inlet end and the outlet end of said housing and defining an interior volume therein;

an inlet pipe and an outlet pipe, respectively extending from said inlet end plate and from said outlet end plate and communicating with the interior volume;

an exhaust baffle assembly disposed generally medially within the interior volume, and defining a sinusoidal exhaust gas path;

an internal inlet end plate disposed across the interior volume of said housing, near said convex inlet end plate;

an internal outlet end plate disposed across the interior volume of said housing, near said convex outlet end plate;

each said internal end plate further including a centrally disposed exhaust gas passage therethrough, with each exhaust gas passage having a first side and a second side opposite the first side;

a first separator panel extending from the first side of the internal inlet end plate exhaust gas passage, sloping toward the opposite side of the housing wall and extending laterally across said housing wall, defining a baffle inlet volume between said first separator panel, said internal inlet end plate, and said housing wall;

a second separator panel extending from the second side of the internal outlet end plate exhaust gas passage, sloping toward the opposite side of the housing wall and extending laterally across said housing wall and disposed parallel to said first separator panel, defining a baffle outlet volume between said second separator panel, said internal outlet end plate, and said housing wall;

a plurality of transverse guides extending between said first separator panel and said second separator panel, and normal thereto;

at least one of said transverse guides further includes at least one resonator tube passage therethrough; and a plurality of resonator tubes extend from the at least one resonator tube passage thereof.

9. The exhaust sound and emission control system according to claim 8, wherein said resonator tubes are of differing lengths from one another.

10. The exhaust sound and emission control system according to claim 8, wherein said resonator tubes are of differing diameters from one another.

11. The exhaust sound and emission control system according to claim 8, wherein said plurality of resonator tubes comprises a branched resonator tube assembly extending from at least one of said transverse guides.

12. The exhaust sound and emission control system according to claim 8, further including:

a concave, transverse internal inlet baffle disposed between said exhaust baffle assembly and said inlet end plate, and defining a catalytic converter inlet chamber therebetween;

a concave, transverse internal outlet baffle disposed between said exhaust baffle assembly and said outlet end plate, and defining a catalytic converter outlet chamber therebetween;

an inlet end catalytic converter element disposed between said inlet end plate and said internal inlet baffle; and an outlet end catalytic converter element disposed between said outlet end plate and said internal outlet baffle.

13. The exhaust sound and emission control system according to claim 8, wherein:

said plurality of transverse guides further includes at least a first upstream guide and a second upstream guide;

said second upstream guide further including a first side and a second side separate therefrom;

the first side and the second side of said second upstream guide joining said first upstream guide to each side of the at least one resonator tube passage thereof; and a divider vane extends between each side of said second upstream guide, through the resonator tube passage of said first upstream guide, and through said at least one resonator tube.

14. The exhaust sound and emission control system according to claim 8, further including:

an inlet volume tube extending from the exhaust gas passage of said internal inlet end plate toward said housing wall, and immediately adjacent said first separator panel; and an outlet volume tube extending from the exhaust gas passage of said internal outlet end plate toward said housing wall, and immediately adjacent said second separator panel.

15. An exhaust sound and emission control system, comprising:

an elongate external housing having a housing wall, an exhaust inlet end, and an exhaust outlet end opposite the exhaust inlet end;

a convex inlet end plate and a convex outlet end plate, respectively secured to and sealing the inlet end and the outlet end of said housing and defining an interior volume therein;

an inlet pipe and an outlet pipe, respectively extending from said inlet end plate and from said outlet end plate and communicating with the interior volume;

an internal inlet end plate disposed across the interior volume of said housing, near said inlet end plate;

an internal outlet end plate disposed across the interior volume of said housing, near said outlet end plate;

each said internal end plate further including a centrally disposed exhaust gas passage therethrough, with each exhaust gas passage having a first side and a second side opposite the first side;

a first separator panel extending from the first side of the internal inlet end plate exhaust gas passage, sloping toward the opposite side of the housing wall and extending laterally across the housing wall, defining a baffle inlet volume between said first separator panel, said internal inlet end plate, and the housing wall;

a second separator panel extending from the second side of the internal outlet end plate exhaust gas passage, sloping toward the opposite side of the housing wall and extending laterally across the housing wall and disposed parallel to said first separator panel, defining a baffle outlet volume between said second separator panel, said internal outlet end plate, and the housing wall;

a plurality of transverse guides extending between said first separator panel and said second separator panel, and normal thereto;

an inlet volume tube extending from the exhaust gas passage of said internal inlet end plate toward the housing wall, and immediately adjacent said first separator panel; and an outlet volume tube extending from the exhaust gas passage of said internal outlet end plate toward the housing wall, and immediately adjacent said second separator panel.

16. The exhaust sound and emission control system according to claim 15, wherein:

at least one of said transverse guides further includes a resonator tube passage therethrough; and at least one resonator tube extends from the resonator tube passage thereof.

17. The exhaust sound and emission control system according to claim 16, wherein said at least one resonator tube comprises a plurality of resonator tubes extending from at least one of said transverse guides, with said plurality of resonator tubes being of differing lengths and diameters from one another.

18. The exhaust sound and emission control system according to claim 16, wherein said at least one resonator tube comprises a branched resonator tube assembly extending from at least one of said transverse guides.

19. The exhaust sound and emission control system according to claim 15, further including:

a concave, transverse internal inlet baffle disposed between said internal inlet end plate and said inlet end plate, and defining a catalytic converter inlet chamber therebetween;

a concave, transverse internal outlet baffle disposed between said internal outlet end plate and said outlet end plate, and defining a catalytic converter outlet chamber therebetween;

an inlet end catalytic converter element disposed between said inlet end plate and said internal inlet baffle; and an outlet end catalytic converter element disposed between said outlet end plate and said internal outlet baffle.

20. The exhaust sound and emission control system according to claim 15, wherein:

said plurality of transverse guides further includes at least a first upstream guide and a second upstream guide;

said first upstream guide further includes a resonator passage therethrough; a resonator tube extends from the resonator passage of said first upstream guide;

said second upstream guide further includes a first side and a second side separate therefrom;

the first side and the second side of said second upstream guide joins said first upstream guide to each side of the resonator tube passage thereof; and a divider vane extends between each side of said second upstream guide, through the resonator tube passage of said first upstream guide, and through said at least one resonator tube.

* * * * *